US008791897B2

(12) United States Patent
Chui et al.

(10) Patent No.: US 8,791,897 B2
(45) **Date of Patent: *Jul. 29, 2014**

(54) METHOD AND SYSTEM FOR WRITING DATA TO MEMS DISPLAY ELEMENTS

(71) Applicant: Qualcomm MEMS Technologies, Inc., San Diego, CA (US)

(72) Inventors: Clarence Chui, San Mateo, CA (US); Manish Kothari, Cupertino, CA (US)

(73) Assignee: Qualcomm MEMS Technologies, Inc., San Diego, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/672,558

(22) Filed: Nov. 8, 2012

(65) Prior Publication Data

US 2013/0063335 A1 Mar. 14, 2013

Related U.S. Application Data

(63) Continuation of application No. 11/234,061, filed on Sep. 22, 2005, now Pat. No. 8,310,441, which is a continuation-in-part of application No. 11/100,762, filed on Apr. 6, 2005, now Pat. No. 7,602,375.

(60) Provisional application No. 60/613,483, filed on Sep. 27, 2004, provisional application No. 60/613,419, filed on Sep. 27, 2004.

(51) Int. Cl.
*G09G 3/34* (2006.01)

(52) U.S. Cl.
USPC ..... 345/108

(58) Field of Classification Search
USPC ..... 345/108
See application file for complete search history.

(56) References Cited

U.S. PATENT DOCUMENTS

| | | | |
|---|---|---|---|
| 3,982,239 | A | 9/1976 | Sherr |
| 4,403,248 | A | 9/1983 | Te Velde |
| 4,441,791 | A | 4/1984 | Hornbeck |
| 4,459,182 | A | 7/1984 | Te Velde |
| 4,482,213 | A | 11/1984 | Piliavin et al. |
| 4,500,171 | A | 2/1985 | Penz et al. |
| 4,519,676 | A | 5/1985 | Te Velde |

(Continued)

FOREIGN PATENT DOCUMENTS

| | | | |
|---|---|---|---|
| DE | 19526656 | A1 | 1/1997 |
| EP | 0173808 | A1 | 3/1986 |

(Continued)

OTHER PUBLICATIONS

Miles M.W. et al., 5.3 Digital PaperTM Reflective Displays using Interferometric Modulation, SID Digest, vol. XXXI, 2000, pp. 32-35.

(Continued)

*Primary Examiner* — Waseem Moorad
(74) *Attorney, Agent, or Firm* — Knobbe, Martens, Olson & Bear, LLP

(57) ABSTRACT

Charge balanced display data writing methods use write and hold cycles of opposite polarity during selected frame update periods. The transitions between voltages of opposite polarity are sufficiently brief that the display elements do not change state. A release cycle may be provided to reduce the chance that a given display element will become stuck in an actuated state.

33 Claims, 10 Drawing Sheets

(56) References Cited

U.S. PATENT DOCUMENTS 4,566,935 A 1/1986 Hornbeck
4,571,603 A 2/1986 Hornbeck et al.
4,596,992 A 6/1986 Hornbeck
4,615,595 A 10/1986 Hornbeck
4,662,746 A 5/1987 Hornbeck
4,681,403 A 7/1987 Te Velde et al.
4,709,995 A 12/1987 Kuribayashi et al.
4,710,732 A 12/1987 Hornbeck
4,856,863 A 8/1989 Sampsell et al.
4,859,060 A 8/1989 Katagiri et al.
4,954,789 A 9/1990 Sampsell
4,956,619 A 9/1990 Hornbeck
4,982,184 A 1/1991 Kirkwood
5,018,256 A 5/1991 Hornbeck
5,028,939 A 7/1991 Hornbeck et al.
5,037,173 A 8/1991 Sampsell et al.
5,055,833 A 10/1991 Hehlen et al.
5,061,049 A 10/1991 Hornbeck
5,078,479 A 1/1992 Vuilleumier
5,079,544 A 1/1992 DeMond et al.
5,083,857 A 1/1992 Hornbeck
5,096,279 A 3/1992 Hornbeck et al.
5,099,353 A 3/1992 Hornbeck
5,124,834 A 6/1992 Cusano et al.
5,142,405 A 8/1992 Hornbeck
5,142,414 A 8/1992 Koehler
5,162,787 A 11/1992 Thompson et al.
5,168,406 A 12/1992 Nelson
5,170,156 A 12/1992 DeMond et al.
5,172,262 A 12/1992 Hornbeck
5,179,274 A 1/1993 Sampsell
5,192,395 A 3/1993 Boysel et al.
5,192,946 A 3/1993 Thompson et al.
5,206,629 A 4/1993 DeMond et al.
5,212,582 A 5/1993 Nelson
5,214,419 A 5/1993 DeMond et al.
5,214,420 A 5/1993 Thompson et al.
5,216,537 A 6/1993 Hornbeck
5,226,099 A 7/1993 Mignardi et al.
5,227,900 A 7/1993 Inaba et al.
5,231,532 A 7/1993 Magel et al.
5,233,385 A 8/1993 Sampsell
5,233,456 A 8/1993 Nelson
5,233,459 A 8/1993 Bozler et al.
5,254,980 A 10/1993 Hendrix et al.
5,272,473 A 12/1993 Thompson et al.
5,278,652 A 1/1994 Urbanus et al.
5,280,277 A 1/1994 Hornbeck
5,285,196 A 2/1994 Gale, Jr.
5,287,096 A 2/1994 Thompson et al.
5,287,215 A 2/1994 Warde et al.
5,296,950 A 3/1994 Lin et al.
5,305,640 A 4/1994 Boysel et al.
5,312,513 A 5/1994 Florence et al.
5,323,002 A 6/1994 Sampsell et al.
5,325,116 A 6/1994 Sampsell
5,327,286 A 7/1994 Sampsell et al.
5,331,454 A 7/1994 Hornbeck
5,339,116 A 8/1994 Urbanus et al.
5,365,283 A 11/1994 Doherty et al.
5,411,769 A 5/1995 Hornbeck
5,444,566 A 8/1995 Gale et al.
5,446,479 A 8/1995 Thompson et al.
5,448,314 A 9/1995 Heimbuch et al.
5,452,024 A 9/1995 Sampsell
5,454,906 A 10/1995 Baker et al.
5,457,493 A 10/1995 Leddy et al.
5,457,566 A 10/1995 Sampsell et al.
5,459,602 A 10/1995 Sampsell
5,461,411 A 10/1995 Florence et al.
5,488,505 A 1/1996 Engle
5,489,952 A 2/1996 Gove et al.
5,497,172 A 3/1996 Doherty et al.
5,497,197 A 3/1996 Gove et al.
5,497,262 A 3/1996 Kaeriyama
5,499,062 A 3/1996 Urbanus
5,506,597 A 4/1996 Thompson et al.
5,515,076 A 5/1996 Thompson et al.
5,517,347 A 5/1996 Sampsell
5,523,803 A 6/1996 Urbanus et al.
5,526,051 A 6/1996 Gove et al.
5,526,172 A 6/1996 Kanack
5,526,327 A 6/1996 Cordova, Jr.
5,526,688 A 6/1996 Boysel et al.
5,535,047 A 7/1996 Hornbeck
5,548,301 A 8/1996 Kornher et al.
5,551,293 A 9/1996 Boysel et al.
5,552,924 A 9/1996 Tregilgas
5,552,925 A 9/1996 Worley
5,563,398 A 10/1996 Sampsell
5,567,334 A 10/1996 Baker et al.
5,570,135 A 10/1996 Gove et al.
5,578,976 A 11/1996 Yao
5,581,272 A 12/1996 Conner et al.
5,583,688 A 12/1996 Hornbeck
5,589,852 A 12/1996 Thompson et al.
5,597,736 A 1/1997 Sampsell
5,598,565 A 1/1997 Reinhardt
5,600,383 A 2/1997 Hornbeck
5,602,671 A 2/1997 Hornbeck
5,606,441 A 2/1997 Florence et al.
5,608,468 A 3/1997 Gove et al.
5,610,438 A 3/1997 Wallace et al.
5,610,624 A 3/1997 Bhuva
5,610,625 A 3/1997 Sampsell
5,612,713 A 3/1997 Bhuva et al.
5,619,061 A 4/1997 Goldsmith et al.
5,619,365 A 4/1997 Rhoads et al.
5,619,366 A 4/1997 Rhoads et al.
5,629,790 A 5/1997 Neukermans et al.
5,633,652 A 5/1997 Kanbe et al.
5,636,052 A 6/1997 Arney et al.
5,638,084 A 6/1997 Kalt
5,638,946 A 6/1997 Zavracky
5,646,768 A 7/1997 Kaeriyama
5,648,793 A 7/1997 Chen
5,650,834 A 7/1997 Nakagawa et al.
5,650,881 A 7/1997 Hornbeck
5,654,741 A 8/1997 Sampsell et al.
5,657,099 A 8/1997 Doherty et al.
5,659,374 A 8/1997 Gale, Jr. et al.
5,665,997 A 9/1997 Weaver et al.
5,699,075 A 12/1997 Miyamoto
5,726,675 A 3/1998 Inoue
5,745,193 A 4/1998 Urbanus et al.
5,745,281 A 4/1998 Yi et al.
5,754,160 A 5/1998 Shimizu et al.
5,771,116 A 6/1998 Miller et al.
5,784,189 A 7/1998 Bozler et al.
5,784,212 A 7/1998 Hornbeck
5,808,780 A 9/1998 McDonald
5,818,095 A 10/1998 Sampsell
5,827,215 A 10/1998 Yoon
5,828,367 A 10/1998 Kuga
5,835,255 A 11/1998 Miles
5,842,088 A 11/1998 Thompson
5,867,302 A 2/1999 Fleming
5,883,608 A 3/1999 Hashimoto
5,883,684 A 3/1999 Millikan et al.
5,912,758 A 6/1999 Knipe et al.
5,943,158 A 8/1999 Ford et al.
5,959,763 A 9/1999 Bozler et al.
5,966,235 A 10/1999 Walker
5,986,796 A 11/1999 Miles
6,008,785 A 12/1999 Hewlett et al.
6,028,690 A 2/2000 Carter et al.
6,037,922 A 3/2000 Yagyu
6,038,056 A 3/2000 Florence et al.
6,040,937 A 3/2000 Miles
6,049,317 A 4/2000 Thompson et al.
6,055,090 A 4/2000 Miles
6,057,903 A 5/2000 Colgan et al.
6,061,075 A 5/2000 Nelson et al.
6,099,132 A 8/2000 Kaeriyama

(56) References Cited

U.S. PATENT DOCUMENTS 6,100,872 A 8/2000 Aratani et al.
6,113,239 A 9/2000 Sampsell et al.
6,147,790 A 11/2000 Meier et al.
6,151,167 A 11/2000 Melville
6,160,833 A 12/2000 Floyd et al.
6,180,428 B1 1/2001 Peeters et al.
6,201,633 B1 3/2001 Peeters et al.
6,232,936 B1 5/2001 Gove et al.
6,232,942 B1 5/2001 Imoto et al.
6,245,590 B1 6/2001 Wine et al.
6,246,398 B1 6/2001 Koo
6,275,326 B1 8/2001 Bhalla et al.
6,282,010 B1 8/2001 Sulzbach et al.
6,295,154 B1 9/2001 Laor et al.
6,304,297 B1 10/2001 Swan
6,323,982 B1 11/2001 Hornbeck
6,324,007 B1 11/2001 Melville
6,327,071 B1 12/2001 Kimura
6,356,085 B1 3/2002 Ryat et al.
6,356,254 B1 3/2002 Kimura
6,362,912 B1 3/2002 Lewis et al.
6,381,022 B1 4/2002 Zavracky
6,429,601 B1 8/2002 Friend et al.
6,433,907 B1 8/2002 Lippert et al.
6,433,917 B1 8/2002 Mei et al.
6,447,126 B1 9/2002 Hornbeck
6,465,355 B1 10/2002 Horsley
6,466,358 B2 10/2002 Tew
6,473,274 B1 10/2002 Maimone et al.
6,480,177 B2 11/2002 Doherty et al.
6,483,456 B2 11/2002 Huisken
6,496,122 B2 12/2002 Sampsell
6,501,107 B1 12/2002 Sinclair et al.
6,505,056 B1 1/2003 Liou
6,507,330 B1 1/2003 Handschy et al.
6,507,331 B1 1/2003 Schlangen et al.
6,522,794 B1 2/2003 Bischel et al.
6,543,286 B2 4/2003 Garverick et al.
6,545,335 B1 4/2003 Chua et al.
6,548,908 B2 4/2003 Chua et al.
6,549,338 B1 4/2003 Wolverton et al.
6,552,840 B2 4/2003 Knipe
6,574,033 B1 6/2003 Chui et al.
6,589,625 B1 7/2003 Kothari et al.
6,593,934 B1 7/2003 Liaw et al.
6,600,201 B2 7/2003 Hartwell et al.
6,606,175 B1 8/2003 Sampsell et al.
6,625,047 B2 9/2003 Coleman, Jr.
6,630,786 B2 10/2003 Cummings et al.
6,632,698 B2 10/2003 Ives
6,633,306 B1 10/2003 Marz et al.
6,636,187 B2 10/2003 Tajima et al.
6,643,069 B2 11/2003 Dewald
6,650,455 B2 11/2003 Miles
6,666,561 B1 12/2003 Blakley
6,674,090 B1 1/2004 Chua et al.
6,674,562 B1 1/2004 Miles
6,680,792 B2 1/2004 Miles
6,690,344 B1 2/2004 Takeuchi et al.
6,710,908 B2 3/2004 Miles et al.
6,741,377 B2 5/2004 Miles
6,741,384 B1 5/2004 Martin et al.
6,741,503 B1 5/2004 Farris et al.
6,747,785 B2 6/2004 Chen et al.
6,762,873 B1 7/2004 Coker et al.
6,775,047 B1 8/2004 Leung et al.
6,775,174 B2 8/2004 Huffman et al.
6,778,155 B2 8/2004 Doherty et al.
6,781,643 B1 8/2004 Watanabe et al.
6,787,384 B2 9/2004 Okumura
6,787,438 B1 9/2004 Nelson
6,788,520 B1 9/2004 Behin et al.
6,792,293 B1 9/2004 Awan et al.
6,794,119 B2 9/2004 Miles
6,811,267 B1 11/2004 Allen et al.
6,813,060 B1 11/2004 Garcia et al.
6,819,469 B1 11/2004 Koba
6,822,628 B2 11/2004 Dunphy et al.
6,829,132 B2 12/2004 Martin et al.
6,853,129 B1 2/2005 Cummings et al.
6,853,418 B2 2/2005 Suzuki et al.
6,855,610 B2 2/2005 Tung et al.
6,859,218 B1 2/2005 Luman et al.
6,861,277 B1 3/2005 Monroe et al.
6,862,022 B2 3/2005 Slupe
6,862,029 B1 3/2005 D'Souza et al.
6,862,141 B2 3/2005 Olczak
6,867,896 B2 3/2005 Miles
6,870,581 B2 3/2005 Li et al.
6,882,461 B1 4/2005 Tsai et al.
6,903,860 B2 6/2005 Ishii
6,972,881 B1 12/2005 Bassetti
7,006,276 B2 * 2/2006 Starkweather et al. ..... 359/290
7,034,783 B2 4/2006 Gates et al.
7,072,093 B2 7/2006 Piehl et al.
7,110,158 B2 9/2006 Miles
7,123,216 B1 10/2006 Miles
7,142,346 B2 11/2006 Chui et al.
7,161,728 B2 1/2007 Sampsell et al.
7,196,837 B2 3/2007 Sampsell et al.
7,242,512 B2 7/2007 Chui et al.
7,289,259 B2 10/2007 Chui et al.
7,291,363 B2 11/2007 Miller
7,327,510 B2 2/2008 Cummings et al.
7,339,993 B1 3/2008 Brooks et al.
7,342,705 B2 3/2008 Chui et al.
7,349,139 B2 3/2008 Chui et al.
7,355,780 B2 4/2008 Chui et al.
7,366,393 B2 4/2008 Cassarly et al.
7,369,296 B2 5/2008 Floyd
7,388,697 B2 6/2008 Chui et al.
7,389,476 B2 6/2008 Senda et al.
7,400,489 B2 7/2008 Van Brocklin et al.
7,489,428 B2 2/2009 Sampsell et al.
7,499,208 B2 3/2009 Mignard
7,508,571 B2 3/2009 Gally et al.
7,515,147 B2 4/2009 Mignard
7,532,195 B2 5/2009 Sampsell
7,532,385 B2 5/2009 Lin et al.
7,545,550 B2 6/2009 Gally et al.
7,545,554 B2 6/2009 Chui et al.
7,551,159 B2 6/2009 Mignard et al.
7,560,299 B2 7/2009 Cummings
7,561,323 B2 7/2009 Gally et al.
7,602,375 B2 10/2009 Chui et al.
7,626,581 B2 12/2009 Chui et al.
7,675,669 B2 3/2010 Gally et al.
7,679,627 B2 3/2010 Sampsell et al.
7,710,632 B2 5/2010 Cummings
7,724,993 B2 5/2010 Chui et al.
7,782,525 B2 8/2010 Sampsell et al.
7,813,026 B2 10/2010 Sampsell
7,843,410 B2 11/2010 Floyd
7,864,402 B2 1/2011 Chui et al.
7,889,163 B2 2/2011 Chui et al.
7,911,428 B2 3/2011 Gally et al.
7,920,136 B2 4/2011 Stewart et al.
7,948,457 B2 5/2011 Kothari et al.
7,957,589 B2 6/2011 Anderson
7,986,451 B2 7/2011 Gally et al.
8,004,504 B2 8/2011 Cummings et al.
8,009,347 B2 8/2011 Chui et al.
8,031,133 B2 10/2011 Gally et al.
8,040,588 B2 10/2011 Chui et al.
8,045,252 B2 10/2011 Chui et al.
8,049,713 B2 11/2011 Sampsell et al.
8,054,528 B2 11/2011 Cummings
8,085,461 B2 12/2011 Gally et al.
8,102,407 B2 1/2012 Gally et al.
8,111,445 B2 2/2012 Chui et al.
8,111,446 B2 2/2012 Gally et al.
8,169,688 B2 5/2012 Sampsell
8,310,441 B2 11/2012 Chui et al.
8,405,649 B2 3/2013 Lewis et al.

(56) References Cited

U.S. PATENT DOCUMENTS

| | | | |
|---|---|---|---|
| 8,514,169 | B2 | 8/2013 | Chui et al. |
| 2001/0003487 | A1 | 6/2001 | Miles |
| 2001/0026250 | A1 | 10/2001 | Inoue et al. |
| 2001/0034075 | A1 | 10/2001 | Onoya |
| 2001/0043171 | A1 | 11/2001 | Van et al. |
| 2001/0046081 | A1 | 11/2001 | Hayashi et al. |
| 2001/0051014 | A1 | 12/2001 | Behin et al. |
| 2001/0052887 | A1 | 12/2001 | Tsutsui et al. |
| 2002/0000959 | A1 | 1/2002 | Colgan et al. |
| 2002/0005827 | A1 | 1/2002 | Kobayashi |
| 2002/0010763 | A1 | 1/2002 | Salo et al. |
| 2002/0015215 | A1 | 2/2002 | Miles |
| 2002/0036304 | A1 | 3/2002 | Ehmke et al. |
| 2002/0050882 | A1 | 5/2002 | Hyman et al. |
| 2002/0075226 | A1 | 6/2002 | Lippincott |
| 2002/0075555 | A1 | 6/2002 | Miles |
| 2002/0093722 | A1 | 7/2002 | Chan et al. |
| 2002/0097133 | A1 | 7/2002 | Charvet et al. |
| 2002/0126354 | A1 | 9/2002 | Jeong et al. |
| 2002/0126364 | A1 | 9/2002 | Miles |
| 2002/0179421 | A1 | 12/2002 | Williams et al. |
| 2002/0186108 | A1 | 12/2002 | Hallbjorner |
| 2002/0190940 | A1 | 12/2002 | Itoh et al. |
| 2003/0004272 | A1 | 1/2003 | Power |
| 2003/0020699 | A1 | 1/2003 | Nakatani et al. |
| 2003/0030608 | A1 | 2/2003 | Kurumisawa et al. |
| 2003/0072070 | A1 | 4/2003 | Miles |
| 2003/0112507 | A1 | 6/2003 | Divelbiss et al. |
| 2003/0122773 | A1 | 7/2003 | Washio et al. |
| 2003/0123125 | A1 | 7/2003 | Little |
| 2003/0137215 | A1 | 7/2003 | Cabuz |
| 2003/0137521 | A1 | 7/2003 | Zehner et al. |
| 2003/0164814 | A1 | 9/2003 | Starkweather et al. |
| 2003/0189536 | A1 | 10/2003 | Ruigt |
| 2003/0202264 | A1 | 10/2003 | Weber et al. |
| 2003/0202265 | A1 | 10/2003 | Reboa et al. |
| 2003/0202266 | A1 | 10/2003 | Ring et al. |
| 2003/0227429 | A1 | 12/2003 | Shimoshikiryo |
| 2004/0008396 | A1 | 1/2004 | Stappaerts |
| 2004/0021658 | A1 | 2/2004 | Chen |
| 2004/0022044 | A1 | 2/2004 | Yasuoka et al. |
| 2004/0026757 | A1 | 2/2004 | Crane, Jr. et al. |
| 2004/0027701 | A1 | 2/2004 | Ishikawa |
| 2004/0051929 | A1 | 3/2004 | Sampsell et al. |
| 2004/0058532 | A1 | 3/2004 | Miles et al. |
| 2004/0080382 | A1 | 4/2004 | Nakanishi et al. |
| 2004/0080479 | A1 | 4/2004 | Credelle |
| 2004/0080516 | A1 | 4/2004 | Kurumisawa et al. |
| 2004/0136596 | A1 | 7/2004 | Oneda et al. |
| 2004/0145049 | A1 | 7/2004 | McKinnell et al. |
| 2004/0145553 | A1 | 7/2004 | Sala et al. |
| 2004/0147056 | A1 | 7/2004 | McKinnell et al. |
| 2004/0160143 | A1 | 8/2004 | Shreeve et al. |
| 2004/0169683 | A1 | 9/2004 | Chiu et al. |
| 2004/0174583 | A1 | 9/2004 | Chen et al. |
| 2004/0179281 | A1 | 9/2004 | Reboa |
| 2004/0212026 | A1 | 10/2004 | Van et al. |
| 2004/0217378 | A1 | 11/2004 | Martin et al. |
| 2004/0217919 | A1 | 11/2004 | Piehl et al. |
| 2004/0218334 | A1 | 11/2004 | Martin et al. |
| 2004/0223204 | A1 | 11/2004 | Mao et al. |
| 2004/0240032 | A1 | 12/2004 | Miles |
| 2004/0240138 | A1 | 12/2004 | Martin et al. |
| 2004/0245588 | A1 | 12/2004 | Nikkel et al. |
| 2004/0263502 | A1 | 12/2004 | Dallas et al. |
| 2004/0263944 | A1 | 12/2004 | Miles et al. |
| 2005/0001545 | A1 | 1/2005 | Aitken et al. |
| 2005/0001828 | A1 | 1/2005 | Martin et al. |
| 2005/0012577 | A1 | 1/2005 | Pillans et al. |
| 2005/0024301 | A1 | 2/2005 | Funston |
| 2005/0038950 | A1 | 2/2005 | Adelmann |
| 2005/0057442 | A1 | 3/2005 | Way |
| 2005/0068583 | A1 | 3/2005 | Gutkowski et al. |
| 2005/0069209 | A1 | 3/2005 | Damera-Venkata et al. |
| 2005/0116924 | A1 | 6/2005 | Sauvante et al. |
| 2005/0174340 | A1 | 8/2005 | Jones |
| 2005/0212734 | A1 | 9/2005 | Kimura |
| 2005/0264472 | A1 | 12/2005 | Rast |
| 2005/0286113 | A1 | 12/2005 | Miles |
| 2005/0286114 | A1 | 12/2005 | Miles |
| 2006/0044291 | A1 | 3/2006 | Willis |
| 2006/0044523 | A1 | 3/2006 | Teijido et al. |
| 2006/0066542 | A1 | 3/2006 | Chui |
| 2006/0066586 | A1 | 3/2006 | Gally et al. |
| 2006/0066594 | A1 | 3/2006 | Tyger |
| 2006/0066595 | A1 | 3/2006 | Sampsell et al. |
| 2006/0066601 | A1 | 3/2006 | Kothari et al. |
| 2006/0066937 | A1 | 3/2006 | Chui |
| 2006/0066938 | A1 | 3/2006 | Chui |
| 2006/0077149 | A1 | 4/2006 | Gally et al. |
| 2006/0077520 | A1 | 4/2006 | Chui et al. |
| 2006/0103613 | A1 | 5/2006 | Chui |
| 2006/0103643 | A1 | 5/2006 | Mathew et al. |
| 2006/0114542 | A1 | 6/2006 | Bloom |
| 2006/0250320 | A1 | 11/2006 | Fuller et al. |
| 2007/0075942 | A1 | 4/2007 | Martin et al. |
| 2007/0126673 | A1 | 6/2007 | Djordjev et al. |
| 2007/0147688 | A1 | 6/2007 | Mathew |
| 2007/0182707 | A1 | 8/2007 | Kothari |
| 2007/0205969 | A1 | 9/2007 | Hagood et al. |
| 2007/0242008 | A1 | 10/2007 | Cummings |
| 2007/0285385 | A1 | 12/2007 | Albert et al. |
| 2007/0290961 | A1 | 12/2007 | Sampsell |
| 2008/0231592 | A1 | 9/2008 | Johnson et al. |
| 2009/0219309 | A1 | 9/2009 | Sampsell |
| 2009/0225069 | A1 | 9/2009 | Sampsell |
| 2009/0273596 | A1 | 11/2009 | Cummings |
| 2010/0245311 | A1 | 9/2010 | Lewis et al. |
| 2010/0315398 | A1 | 12/2010 | Chui et al. |
| 2011/0128307 | A1 | 6/2011 | Gally et al. |
| 2011/0141163 | A1 | 6/2011 | Gally et al. |
| 2011/0148751 | A1 | 6/2011 | Gally et al. |
| 2011/0316861 | A1 | 12/2011 | Gally et al. |
| 2012/0001962 | A1 | 1/2012 | Chui et al. |
| 2012/0026176 | A1 | 2/2012 | Cummings |
| 2012/0044563 | A1 | 2/2012 | Cummings et al. |
| 2012/0099177 | A1 | 4/2012 | Chui et al. |
| 2012/0212796 | A1 | 8/2012 | Sampsell |

FOREIGN PATENT DOCUMENTS

| | | | |
|---|---|---|---|
| EP | 0295802 | A1 | 12/1988 |
| EP | 0300754 | A2 | 1/1989 |
| EP | 0306308 | A2 | 3/1989 |
| EP | 0318050 | A2 | 5/1989 |
| EP | 0417523 | A2 | 3/1991 |
| EP | 0467048 | A2 | 1/1992 |
| EP | 0554109 | A1 | 8/1993 |
| EP | 0570906 | A1 | 11/1993 |
| EP | 0608056 | A1 | 7/1994 |
| EP | 0655725 | A1 | 5/1995 |
| EP | 0667548 | A1 | 8/1995 |
| EP | 0725380 | A1 | 8/1996 |
| EP | 0852371 | A1 | 7/1998 |
| EP | 0911794 | A1 | 4/1999 |
| EP | 1017038 | A2 | 7/2000 |
| EP | 1039311 | A1 | 9/2000 |
| EP | 1134721 | | 9/2001 |
| EP | 1146533 | A1 | 10/2001 |
| EP | 1239448 | A2 | 9/2002 |
| EP | 1258860 | A1 | 11/2002 |
| EP | 1280129 | A2 | 1/2003 |
| EP | 1341025 | A1 | 9/2003 |
| EP | 1343190 | A2 | 9/2003 |
| EP | 1345197 | A1 | 9/2003 |
| EP | 1381023 | A2 | 1/2004 |
| EP | 1414011 | A1 | 4/2004 |
| EP | 1473691 | A2 | 11/2004 |
| FR | 2851683 | | 8/2004 |
| GB | 2401200 | | 11/2004 |
| JP | 63055590 | | 3/1988 |
| JP | 11352938 | A | 12/1999 |
| JP | 2000075963 | | 3/2000 |
| JP | 2000121970 | A | 4/2000 |

(56) References Cited

FOREIGN PATENT DOCUMENTS

| | | | |
|---|---|---|---|
| JP | 2001324959 | A | 11/2001 |
| JP | 2002072974 | A | 3/2002 |
| JP | 2002175053 | | 6/2002 |
| JP | 2002341267 | A | 11/2002 |
| JP | 2003058134 | A | 2/2003 |
| JP | 2004004553 | | 1/2004 |
| JP | 2004029571 | A | 1/2004 |
| JP | 2004145286 | A | 5/2004 |
| JP | 2008541155 | A | 11/2008 |
| KR | 1019900014917 | | 10/1990 |
| KR | 1019970004635 | | 1/1997 |
| KR | 1019990007149 | | 1/1999 |
| TW | 546672 | B | 8/2003 |
| TW | 552720 | B | 9/2003 |
| TW | 200528388 | | 9/2005 |
| WO | WO-9428452 | A1 | 12/1994 |
| WO | WO-0108441 | A1 | 2/2001 |
| WO | WO-0173937 | A2 | 10/2001 |
| WO | WO-02089103 | A2 | 11/2002 |
| WO | WO-03015071 | A2 | 2/2003 |
| WO | WO-03044765 | A2 | 5/2003 |
| WO | WO-03060940 | A1 | 7/2003 |
| WO | WO-03079323 | A1 | 9/2003 |
| WO | WO-03090199 | A1 | 10/2003 |
| WO | WO-03090241 | A2 | 10/2003 |
| WO | WO-2004049034 | A1 | 6/2004 |
| WO | WO-2004054088 | A2 | 6/2004 |
| WO | WO-2004093041 | A2 | 10/2004 |
| WO | WO-2005071651 | A1 | 8/2005 |

OTHER PUBLICATIONS

Office Action dated Feb. 11, 2008 in U.S. Appl. No. 11/100,762.
Office Action dated Aug. 11, 2008 in U.S. Appl. No. 11/100,762.
Office Action dated Dec. 4, 2008 in U.S. Appl. No. 11/100,762.
Office Action dated Jan. 20, 2012 in U.S. Appl. No. 12/578,547.
Office Action dated Jun. 28, 2012 in U.S. Appl. No. 12/578,547.
Office Action dated Oct. 8, 2008 in U.S. Appl. No. 11/234,061.
Office Action dated Apr. 30, 2009 in U.S. Appl. No. 11/234,061.
Office Action dated Sep. 18, 2009 in U.S. Appl. No. 11/234,061.
Office Action dated Apr. 14, 2010 in U.S. Appl. No. 11/234,061.
Office Action dated Jan. 28, 2011, in U.S. Appl. No. 11/234,061.
Office Action dated Jul. 11, 2011, in U.S. Appl. No. 11/234,061.
Office Action dated Dec. 30, 2011, in U.S. Appl. No. 11/234,061.
Partial Search Report dated May 7, 2008 for European App. No. 05255639.6.
Extended Search Report dated Aug. 11, 2008 for European App. No. 05255639.6.
Office Action dated May 9, 2008 in Chinese App. No. 200510103441.5.
Office Action dated Apr. 3, 2009 in Chinese App. No. 200510103441.5.
Notice of Reasons for Rejection dated Sep. 29, 2009 in Japanese App. No. 2005-226224.
Notice of Reasons for Rejection dated Feb. 23, 2010 in Japanese App. No. 2005-226224.
Notice of Reasons for Rejection dated Jul. 10, 2012 in Japanese App. No. 2010-228486.
Notice to Submit a Response dated Nov. 30, 2011 in Korean App. No. 10-2005-0084146.
Office Action dated Nov. 23, 2011 in Taiwanese App. No. 094130567.
Office Action dated Dec. 3, 2012 in U.S. Appl. No. 12/578,547.
Office Action dated Jan. 7, 2011 in U.S. Appl. No. 12/851,523.
Office Action dated Jul. 11, 2011 in U.S. Appl. No. 12/851,523.
Office Action dated Dec. 23, 2011 in U.S. Appl. No. 12/851,523.
Official Communication dated Sep. 28, 2012 for European App. No. 05255639.6.
Bains, "Digital Paper Display Technology Holds Promise for Portables," CommsDesign EE Times, 2000.
Chen, et al., "Low Peak Current Driving Scheme for Passive Matrix-OLED," SID International Symposium Digest of Technical Papers, May 2003, pp. 504-507.
Lieberman, "MEMS Display Looks to give PDAs Sharper Image." EE Times (2004).
Lieberman, "MEMS Display Looks to Give PDAs Sharper Image," EE Times (Feb. 11, 1997).
Lieberman, "Microbridges at heart of new MEMS displays" EE Times (2004).
Miles et al., "10.1: Digital PaperTM for Reflective Displays," 2002 SID International Symposium Digest of Technical Papers Boston MASID International Symposium Digest of Technical Papers San Jose, 2002, 115-117.
Miles M.W., "MEMS-Based Interferometric Modulator for Display Applications," Proceedings of SPIE Conference on Micromachined Devices and Components V, Sep. 1999, SPIE vol. 3876, pp. 20-28.
Peroulis et al., "Low contact resistance series MEMS switches", 2002, pp. 223-226, vol. 1, IEEE MTTS International Microwave Symposium Digest, New York, NY.
Seeger, et al., "Stabilization of Electrostatically Actuated Mechanical Devices," International Conference on Solid State Sensors and Actuators, 1997, vol. 2, 1133-1136.
U.S. Appl. No. 08/554,630, filed Nov. 6, 1995 (Abandoned).
U.S. Appl. No. 60/613,419, filed Sep. 27, 2004 (Expired).

* cited by examiner

| | | Column Output Signals | |
|---|---|---|---|
| | | + $V_{bias}$ | -$V_{bias}$ |
| Row Output Signals | 0 | Stable | Stable |
| | + ΔV | Release | Actuate |
| | −ΔV | Actuate | Release |

METHOD AND SYSTEM FOR WRITING DATA TO MEMS DISPLAY ELEMENTS

CROSS REFERENCE TO RELATED APPLICATIONS

This application is a continuation of U.S. application Ser. No. 11/234,061, entitled "Method and System for Writing Data to Mems Display Elements," and filed on Sep. 22, 2005, which is a continuation-in-part of U.S. application Ser. No. 11/100,762, entitled "METHOD AND SYSTEM FOR WRITING DATA TO MEMS DISPLAY ELEMENTS," and filed on Apr. 6, 2005, now U.S. Pat. No. 7,602,375, which claims priority under 35 U.S.C. Section 119(e) to U.S. Provisional Application 60/613,483, entitled "Method and Device for Driving Interferometric Modulators," and filed on Sep. 27, 2004, and U.S. Provisional Application 60/613,419 entitled Method and Device for Driving Interferometric Modulators with Hysteresis and filed on Sep. 27, 2004, each of which are hereby expressly incorporated by reference in their entirety.

BACKGROUND

Microelectromechanical systems (MEMS) include micro mechanical elements, actuators, and electronics. Micromechanical elements may be created using deposition, etching, and or other micromachining processes that etch away parts of substrates and/or deposited material layers or that add layers to form electrical and electromechanical devices. One type of MEMS device is called an interferometric modulator. An interferometric modulator may comprise a pair of conductive plates, one or both of which may be transparent and/or reflective in whole or part and capable of relative motion upon application of an appropriate electrical signal. One plate may comprise a stationary layer deposited on a substrate, the other plate may comprise a metallic membrane separated from the stationary layer by an air gap. Such devices have a wide range of applications, and it would be beneficial in the art to utilize and/or modify the characteristics of these types of devices so that their features can be exploited in improving existing products and creating new products that have not yet been developed.

SUMMARY

The system, method, and devices of the invention each have several aspects, no single one of which is solely responsible for its desirable attributes. Without limiting the scope of this invention, its more prominent features will now be discussed briefly. After considering this discussion, and particularly after reading the section entitled "Detailed Description of Certain Embodiments" one will understand how the features of this invention provide advantages over other display devices.

In one embodiment, a method of actuating a MEMS display element is provided, wherein the MEMS display element comprises a portion of an array of MEMS display elements. The method includes writing display data to the MEMS display element with a potential difference of a first polarity during a first portion of a display write process, and re-writing the display data to the MEMS display element with a potential difference having a polarity opposite the first polarity during a second portion of the display write process. Subsequently, a first bias potential having the first polarity is applied to the MEMS display element during a third portion of the display write process and a second bias potential having the opposite polarity is applied to the MEMS display element during a fourth portion of the display write process.

In another embodiment, a method of maintaining a frame of display data on an array of MEMS display elements includes alternately applying approximately equal bias voltages of opposite polarities to the MEMS display elements for periods of time defined at least in part by the inverse of a rate at which frames of display data are received by a display system. Each period of time may be substantially equal to 1/(2f) or 1/(4f), wherein f is a defined frequency of frame refresh cycles.

In another embodiment, a method of writing frames of display data to an array of MEMS display elements at a rate of one frame per defined frame update period includes writing display data to the MEMS display elements, wherein the writing takes less than the frame update period and applying a series of bias potentials of alternating polarity to the MEMS display elements for the remainder of the frame update period.

Display devices are also provided. In one such embodiment, a MEMS display device is configured to display images at a frame update rate, the frame update rate defining a frame update period. The display device includes row and column driver circuitry configured to apply a polarity balanced sequence of bias voltages to substantially all columns of a MEMS display array for portions of at least one frame update period, wherein the portions are defined by a time remaining between completing a frame write process for a first frame, and beginning a frame write process for a next subsequent frame.

DETAILED DESCRIPTION OF PREFERRED EMBODIMENTS

The following detailed description is directed to certain specific embodiments of the invention. However, the invention can be embodied in a multitude of different ways. In this description, reference is made to the drawings wherein like parts are designated with like numerals throughout. As will be apparent from the following description, the invention may be implemented in any device that is configured to display an image, whether in motion (e.g., video) or stationary (e.g., still image), and whether textual or pictorial. More particularly, it is contemplated that the invention may be implemented in or associated with a variety of electronic devices such as, but not limited to, mobile telephones, wireless devices, personal data assistants (PDAs), hand-held or portable computers, GPS receivers/navigators, cameras, MP3 players, camcorders, game consoles, wrist watches, clocks, calculators, television monitors, flat panel displays, computer monitors, auto displays (e.g., odometer display, etc.), cockpit controls and/or displays, display of camera views (e.g., display of a rear view camera in a vehicle), electronic photographs, electronic billboards or signs, projectors, architectural structures, packaging, and aesthetic structures (e.g., display of images on a piece of jewelry). MEMS devices of similar structure to those described herein can also be used in non-display applications such as in electronic switching devices.

Figure 1:
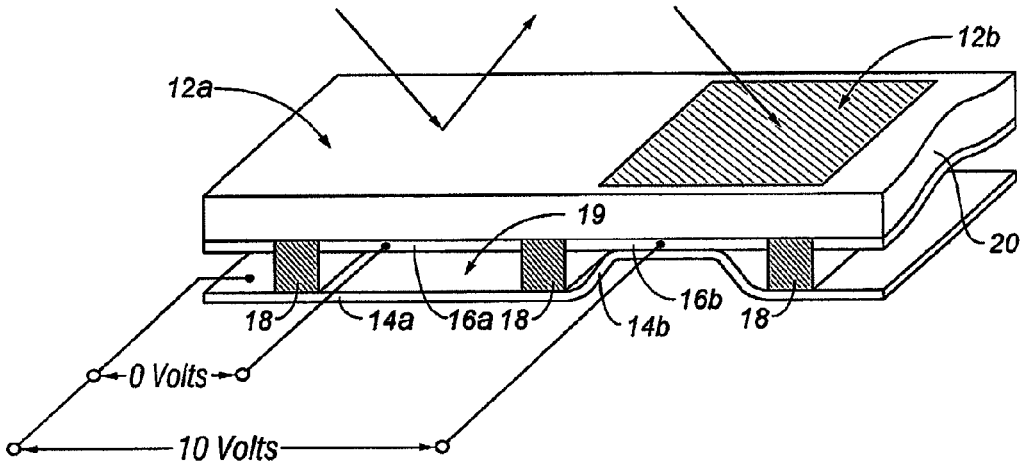
FIG. 1 is an isometric view depicting a portion of one embodiment of an interferometric modulator display in which a movable reflective layer of a first interferometric modulator is in a released position and a movable reflective layer of a second interferometric modulator is in an actuated position.

One interferometric modulator display embodiment comprising an interferometric MEMS display element is illustrated in FIG. 1. In these devices, the pixels are in either a bright or dark state. In the bright ("on" or "open") state, the display element reflects a large portion of incident visible light to a user. When in the dark ("off" or "closed") state, the display element reflects little incident visible light to the user. Depending on the embodiment, the light reflectance properties of the "on" and "off" states may be reversed. MEMS pixels can be configured to reflect predominantly at selected colors, allowing for a color display in addition to black and white.

FIG. 1 is an isometric view depicting two adjacent pixels in a series of pixels of a visual display, wherein each pixel comprises a MEMS interferometric modulator. In some embodiments, an interferometric modulator display comprises a row/column array of these interferometric modulators. Each interferometric modulator includes a pair of reflective layers positioned at a variable and controllable distance from each other to form a resonant optical cavity with at least one variable dimension. In one embodiment, one of the reflective layers may be moved between two positions. In the first position, referred to herein as the released state, the movable layer is positioned at a relatively large distance from a fixed partially reflective layer. In the second position, the movable layer is positioned more closely adjacent to the partially reflective layer. Incident light that reflects from the two layers interferes constructively or destructively depending on the position of the movable reflective layer, producing either an overall reflective or non-reflective state for each pixel.

The depicted portion of the pixel array in FIG. 1 includes two adjacent interferometric modulators 12*a* and 12*b*. In the interferometric modulator 12*a* on the left, a movable and highly reflective layer 14*a* is illustrated in a released position at a predetermined distance from a fixed partially reflective layer 16*a*. In the interferometric modulator 12*b* on the right, the movable highly reflective layer 14*b* is illustrated in an actuated position adjacent to the fixed partially reflective layer 16*b*.

The fixed layers 16*a*, 16*b* are electrically conductive, partially transparent and partially reflective, and may be fabricated, for example, by depositing one or more layers each of chromium and indium-tin-oxide onto a transparent substrate 20. The layers are patterned into parallel strips, and may form row electrodes in a display device as described further below. The movable layers 14*a*, 14*b* may be formed as a series of parallel strips of a deposited metal layer or layers (orthogonal to the row electrodes 16*a*, 16*b*) deposited on top of posts 18 and an intervening sacrificial material deposited between the posts 18. When the sacrificial material is etched away, the deformable metal layers are separated from the fixed metal layers by a defined air gap 19. A highly conductive and reflective material such as aluminum may be used for the deformable layers, and these strips may form column electrodes in a display device.

With no applied voltage, the cavity 19 remains between the layers 14*a*, 16*a* and the deformable layer is in a mechanically relaxed state as illustrated by the pixel 12*a* in FIG. 1. However, when a potential difference is applied to a selected row and column, the capacitor formed at the intersection of the row and column electrodes at the corresponding pixel becomes charged, and electrostatic forces pull the electrodes together. If the voltage is high enough, the movable layer is deformed and is forced against the fixed layer (a dielectric material which is not illustrated in this Figure may be deposited on the fixed layer to prevent shorting and control the separation distance) as illustrated by the pixel 12*b* on the right in FIG. 1. The behavior is the same regardless of the polarity of the applied potential difference. In this way, row/column actuation that can control the reflective vs. non-reflective pixel states is analogous in many ways to that used in conventional LCD and other display technologies.

Figure 2:
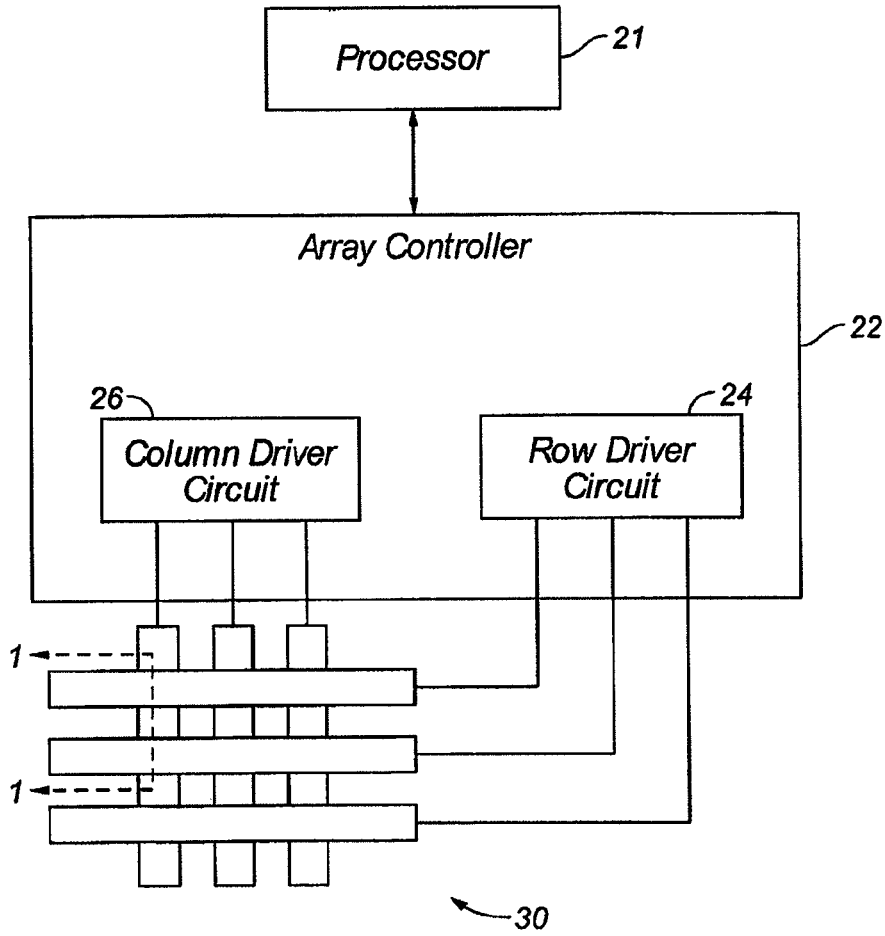
FIG. 2 is a system block diagram illustrating one embodiment of an electronic device incorporating a 3×3 interferometric modulator display.

FIGS. 2 through 5 illustrate one exemplary process and system for using an array of interferometric modulators in a display application. FIG. 2 is a system block diagram illustrating one embodiment of an electronic device that may incorporate aspects of the invention. In the exemplary embodiment, the electronic device includes a processor 21 which may be any general purpose single- or multi-chip microprocessor such as an ARM, Pentium®, Pentium II®, Pentium III®, Pentium IV®, Pentium® Pro, an 8051, a MIPS®, a Power PC®, an ALPHA®, or any special purpose microprocessor such as a digital signal processor, microcontroller, or a programmable gate array. As is conventional in the art, the processor 21 may be configured to execute one or more software modules. In addition to executing an operating system, the processor may be configured to execute one or more software applications, including a web browser, a telephone application, an email program, or any other software application.

In one embodiment, the processor 21 is also configured to communicate with an array controller 22. In one embodiment, the array controller 22 includes a row driver circuit 24 and a column driver circuit 26 that provide signals to a pixel array 30. The cross section of the array illustrated in FIG. 1 is shown by the lines 1-1 in FIG. 2. For MEMS interferometric modulators, the row/column actuation protocol may take advantage of a hysteresis property of these devices illustrated in FIG. 3. It may require, for example, a 10 volt potential difference to cause a movable layer to deform from the released state to the actuated state. However, when the voltage is reduced from that value, the movable layer maintains its state as the voltage drops back below 10 volts. In the exemplary embodiment of FIG. 3, the movable layer does not release completely until the voltage drops below 2 volts. There is thus a range of voltage, about 3 to 7 V in the example illustrated in FIG. 3, where there exists a window of applied voltage within which the device is stable in either the released or actuated state. This is referred to herein as the "hysteresis window" or "stability window." For a display array having the hysteresis characteristics of FIG. 3, the row/column actuation protocol can be designed such that during row strobing, pixels in the strobed row that are to be actuated are exposed to a voltage difference of about 10 volts, and pixels that are to be released are exposed to a voltage difference of close to zero volts. After the strobe, the pixels are exposed to a steady state voltage difference of about 5 volts such that they remain in whatever state the row strobe put them in. After being written, each pixel sees a potential difference within the "stability window" of 3-7 volts in this example. This feature makes the pixel design illustrated in FIG. 1 stable under the same applied voltage conditions in either an actuated or released pre-existing state. Since each pixel of the interferometric modulator, whether in the actuated or released state, is essentially a capacitor formed by the fixed and moving reflective layers, this stable state can be held at a voltage within the hysteresis window with almost no power dissipation. Essentially no current flows into the pixel if the applied potential is fixed.

In typical applications, a display frame may be created by asserting the set of column electrodes in accordance with the desired set of actuated pixels in the first row. A row pulse is then applied to the row 1 electrode, actuating the pixels corresponding to the asserted column lines. The asserted set of column electrodes is then changed to correspond to the desired set of actuated pixels in the second row. A pulse is then applied to the row 2 electrode, actuating the appropriate pixels in row 2 in accordance with the asserted column electrodes. The row 1 pixels are unaffected by the row 2 pulse, and remain in the state they were set to during the row 1 pulse. This may be repeated for the entire series of rows in a sequential fashion to produce the frame. Generally, the frames are refreshed and/or updated with new display data by continually repeating this process at some desired number of frames per second. A wide variety of protocols for driving row and column electrodes of pixel arrays to produce display frames are also well known and may be used in conjunction with the present invention.

Figures 3, 4:
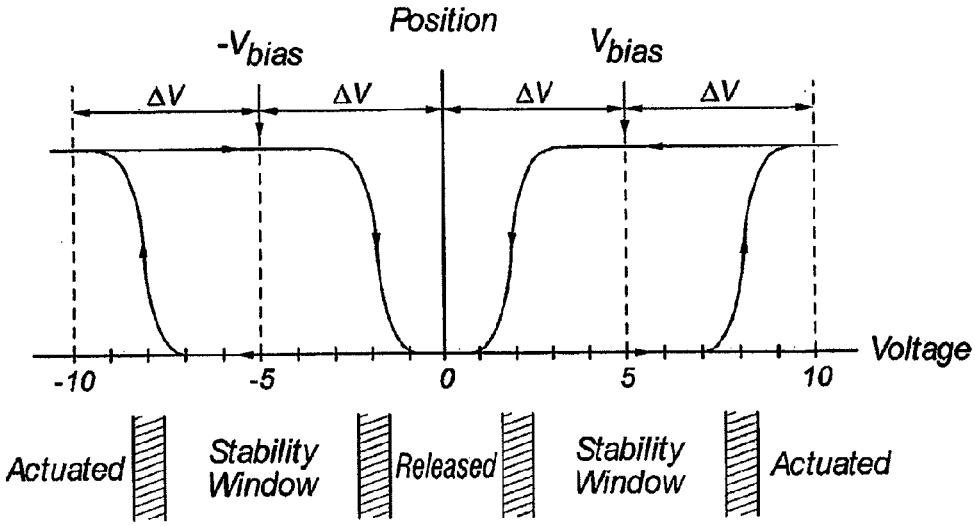
FIG. 3 is a diagram of movable mirror position versus applied voltage for one exemplary embodiment of an interferometric modulator of FIG. 1.
FIG. 4 is an illustration of a set of row and column voltages that may be used to drive an interferometric modulator display.

FIGS. 4 and 5 illustrate one possible actuation protocol for creating a display frame on the 3×3 array of FIG. 2. FIG. 4 illustrates a possible set of column and row voltage levels that may be used for pixels exhibiting the hysteresis curves of FIG. 3. In the FIG. 4 embodiment, actuating a pixel involves setting the appropriate column to $-V_{bias}$, and the appropriate row to $+\Delta V$, which may correspond to −5 volts and +5 volts respectively Releasing the pixel is accomplished by setting the appropriate column to $+V_{bias}$, and the appropriate row to the same $+\Delta V$, producing a zero volt potential difference across the pixel. In those rows where the row voltage is held at zero volts, the pixels are stable in whatever state they were originally in, regardless of whether the column is at $+V_{bias}$, or $-V_{bias}$. As is also illustrated in FIG. 4, it will be appreciated that voltages of opposite polarity than those described above can be used, e.g., actuating a pixel can involve setting the appropriate column to $+V_{bias}$, and the appropriate row to $-\Delta V$. In this embodiment, releasing the pixel is accomplished by setting the appropriate column to $-V_{bias}$, and the appropriate row to the same $-\Delta V$, producing a zero volt potential difference across the pixel.

Figure 5A:
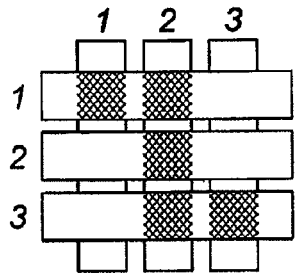
FIGS. 5A and 5B illustrate one exemplary timing diagram for row and column signals that may be used to write a frame of display data to the 3×3 interferometric modulator display of FIG. 2.
Figure 5B:
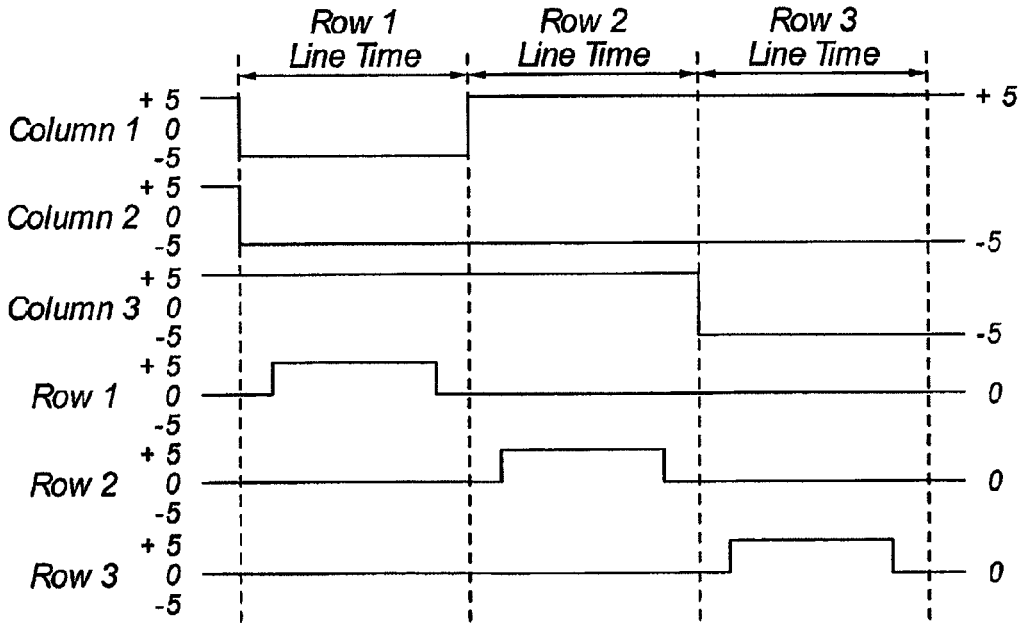

FIG. 5B is a timing diagram showing a series of row and column signals applied to the 3×3 array of FIG. 2 which will result in the display arrangement illustrated in FIG. 5A, where actuated pixels are non-reflective. Prior to writing the frame illustrated in FIG. 5A, the pixels can be in any state, and in this example, all the rows are at 0 volts, and all the columns are at +5 volts. With these applied voltages, all pixels are stable in their existing actuated or released states.

In the FIG. 5A frame, pixels (1,1), (1,2), (2,2), (3,2) and (3,3) are actuated. To accomplish this, during a "line time" for row 1, columns 1 and 2 are set to −5 volts, and column 3 is set to +5 volts. This does not change the state of any pixels, because all the pixels remain in the 3-7 volt stability window. Row 1 is then strobed with a pulse that goes from 0, up to 5 volts, and back to zero. This actuates the (1,1) and (1,2) pixels and releases the (1,3) pixel. No other pixels in the array are affected. To set row 2 as desired, column 2 is set to −5 volts, and columns 1 and 3 are set to +5 volts. The same strobe applied to row 2 will then actuate pixel (2,2) and release pixels (2,1) and (2,3). Again, no other pixels of the array are affected. Row 3 is similarly set by setting columns 2 and 3 to −5 volts, and column 1 to +5 volts. The row 3 strobe sets the row 3 pixels as shown in FIG. 5A. After writing the frame, the row potentials are zero, and the column potentials can remain at either +5 or −5 volts, and the display is then stable in the arrangement of FIG. 5A. It will be appreciated that the same procedure can be employed for arrays of dozens or hundreds of rows and columns. It will also be appreciated that the timing, sequence, and levels of voltages used to perform row and column actuation can be varied widely within the general principles outlined above, and the above example is exemplary only, and any actuation voltage method can be used with the present invention.

Figure 6A:
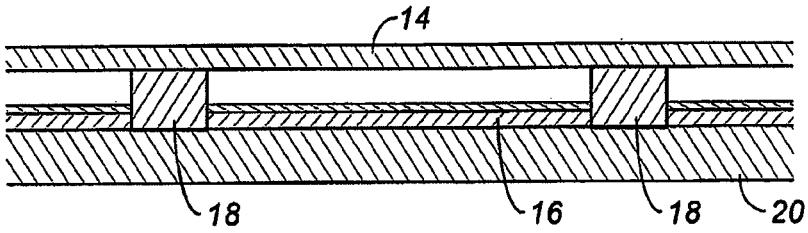
FIG. 6A is a cross section of the device of FIG. 1.
Figure 6B:
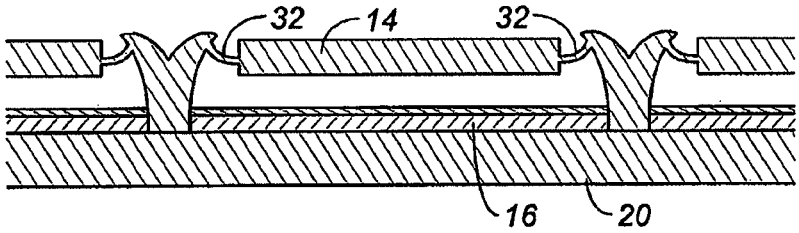
FIG. 6B is a cross section of an alternative embodiment of an interferometric modulator.
Figure 6C:
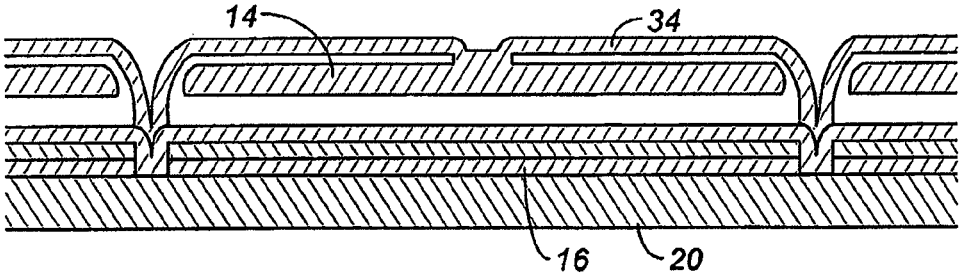
FIG. 6C is a cross section of another alternative embodiment of an interferometric modulator.

The details of the structure of interferometric modulators that operate in accordance with the principles set forth above may vary widely. For example, FIGS. 6A-6C illustrate three different embodiments of the moving mirror structure. FIG. 6A is a cross section of the embodiment of FIG. 1, where a strip of metal material 14 is deposited on orthogonally extending supports 18. In FIG. 6B, the moveable reflective material 14 is attached to supports at the corners only, on tethers 32. In FIG. 6C, the moveable reflective material 14 is suspended from a deformable layer 34. This embodiment has benefits because the structural design and materials used for the reflective material 14 can be optimized with respect to the optical properties, and the structural design and materials used for the deformable layer 34 can be optimized with respect to desired mechanical properties. The production of various types of interferometric devices is described in a variety of published documents, including, for example, U.S. Published Application 2004/0051929. A wide variety of well known techniques may be used to produce the above described structures involving a series of material deposition, patterning, and etching steps.

It is one aspect of the above described devices that charge can build on the dielectric between the layers of the device, especially when the devices are actuated and held in the actuated state by an electric field that is always in the same direction. For example, if the moving layer is always at a higher potential relative to the fixed layer when the device is actuated by potentials having a magnitude larger than the outer threshold of stability, a slowly increasing charge buildup on the dielectric between the layers can begin to shift the hysteresis curve for the device. This is undesirable as it causes display performance to change over time, and in different ways for different pixels that are actuated in different ways over time. As can be seen in the example of FIG. 5B, a given pixel sees a 10 volt difference during actuation, and every time in this example, the row electrode is at a 10 V higher potential than the column electrode. During actuation, the electric field between the plates therefore always points in one direction, from the row electrode toward the column electrode.

This problem can be reduced by actuating the MEMS display elements with a potential difference of a first polarity during a first portion of the display write process, and actuating the MEMS display elements with a potential difference having a polarity opposite the first polarity during a second portion of the display write process. This basic principle is illustrated in FIGS. 7, 8A, and 8B.

Figure 7:
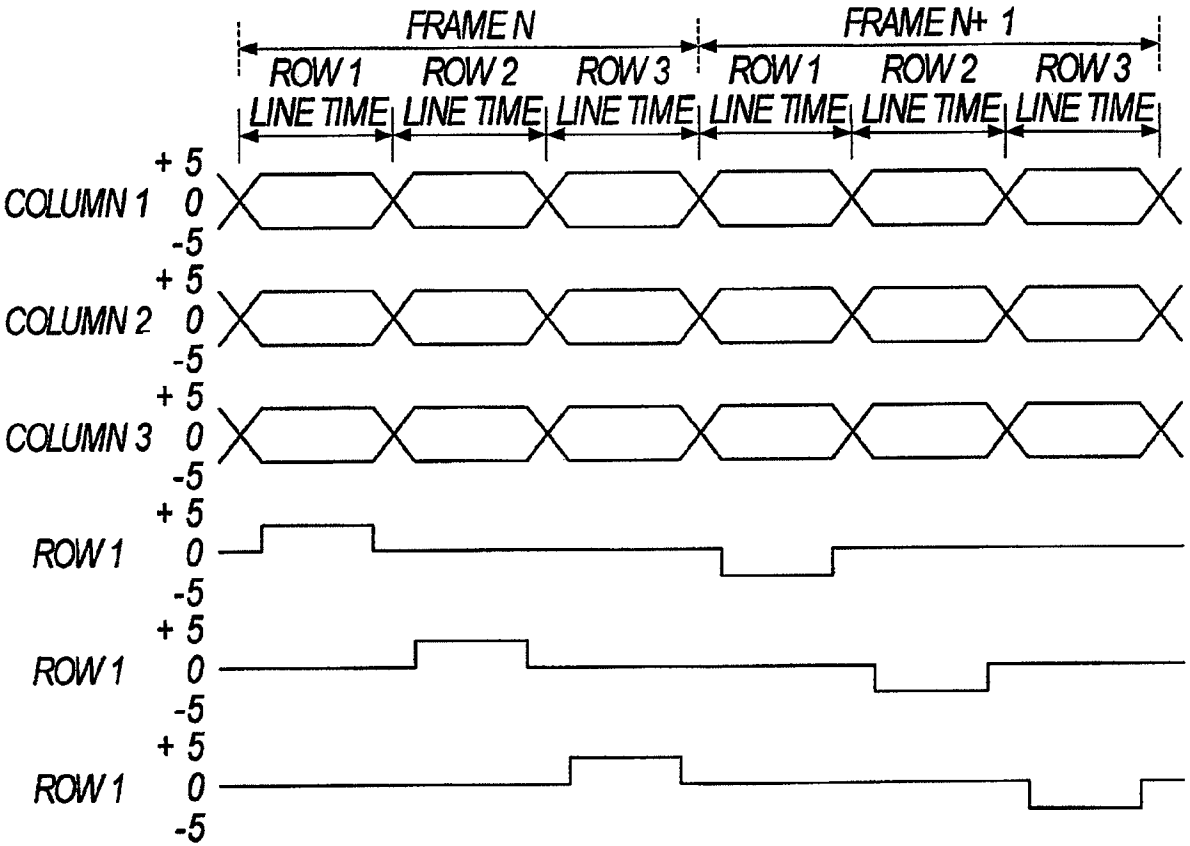
FIG. 7 is a timing diagram illustrating application of opposite write polarities to different frames of display data.

In FIG. 7, two frames of display data are written in sequence, frame N and frame N+1. In this Figure, the data for the columns goes valid for row 1 (i.e., either +5 or −5 depending on the desired state of the pixels in row 1) during the row 1 line time, valid for row 2 during the row 2 line time, and valid for row 3 during the row 3 line time. Frame N is written as shown in FIG. 5B, which will be termed positive polarity herein, with the row electrode 10 V above the column electrode during MEMS device actuation. During actuation, the column electrode may be at −5 V, and the scan voltage on the row is +5 V in this example. The actuation and release of display elements for Frame N is thus performed according to the center row of FIG. 4 above.

Frame N+1 is written in accordance with the lowermost row of FIG. 4. For Frame N+1, the scan voltage is −5 V, and the column voltage is set to +5 V to actuate, and −5 V to release. Thus, in Frame N+1, the column voltage is 10 V above the row voltage, termed a negative polarity herein. As the display is continually refreshed and/or updated, the polarity can be alternated between frames, with Frame N+2 being written in the same manner as Frame N, Frame N+3 written in the same manner as Frame N+1, and so on. In this way, actuation of pixels takes place in both polarities. In embodiments following this principle, potentials of opposite polarities are respectively applied to a given MEMS element at defined times and for defined time durations that depend on the rate at which image data is written to MEMS elements of the array, and the opposite potential differences are each applied an approximately equal amount of time over a given period of display use. This helps reduce charge buildup on the dielectric over time.

A wide variety of modifications of this scheme can be implemented. For example, Frame N and Frame N+1 can comprise different display data. Alternatively, it can be the same display data written twice to the array with opposite polarities. One specific embodiment wherein the same data is written twice with opposite polarity signals is illustrated in additional detail in FIG. 8.

In this Figure, Frame N and N+1 update periods are illustrated. These update periods are typically the inverse of a selected frame update rate that is defined by the rate at which new frames of display data are received by the display system. This rate may, for example, be 15 Hz, 30 Hz, or another frequency depending on the nature of the image data being displayed.

Figure 8:
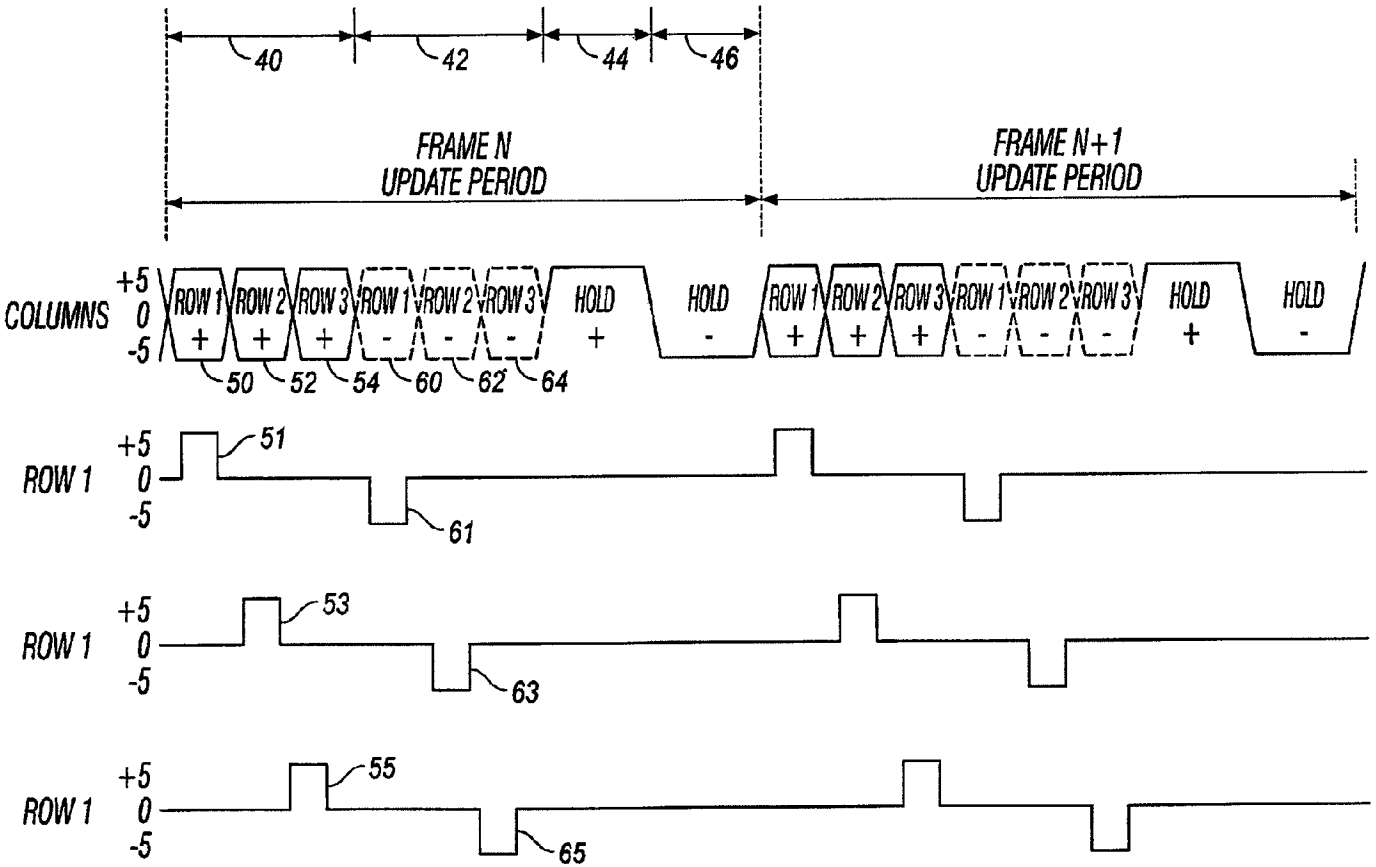
FIG. 8 is a timing diagram illustrating write and hold cycles during a frame update period in a first embodiment of the invention.

It is one feature of the display elements described herein that a frame of data can generally be written to the array of display elements in a time period shorter than the update period defined by the frame update rate. In the embodiment of FIG. 8, the frame update period is divided into four portions or intervals, designated 40, 42, 44, and 46 in FIG. 8. FIG. 8 illustrates a timing diagram for a 3 row display, such as illustrated in FIG. 5A.

During the first portion 40 of a frame update period, the frame is written with potential differences across the modulator elements of a first polarity. For example, the voltages applied to the rows and columns may follow the polarity illustrated by the center row of FIG. 4 and FIG. 5B. As with FIG. 7, in FIG. 8, the column voltages are not shown individually, but are indicated as a multi-conductor bus, where the column voltages are valid for row 1 data during period 50, are valid for row 2 data during period 52, and valid for row 3 data during period 54, wherein "valid" is a selected voltage which differs depending on the desired state of a display element in the column to be written. In the example of FIG. 5B, each column may assume a potential of +5 or −5 depending on the desired display element state. As explained above, row pulse 51 sets the state of row 1 display elements as desired, row pulse 53 sets the state of row 2 display elements as desired, and row pulse 55 sets the state of row 3 display elements as desired.

During a second portion 42 of the frame update period, the same data is written to the array with the opposite polarities applied to the display elements. During this period, the voltages present on the columns are the opposite of what they were during the first portion 40. If the voltage was, for example, +5 volts on a column during time period 50, it will be −5 volts during time period 60, and vice versa. The same is true for sequential applications of sets of display data to the columns, e.g., the potential during period 62 is opposite to that of 52, and the potential during period 64 is opposite to that applied during time period 54. Row strobes 61, 63, 65 of opposite polarity to those provided during the first portion 40 of the frame update period re-write the same data to the array during second portion 42 as was written during portion 40, but the polarity of the applied voltage across the display elements is reversed.

In the embodiment illustrated in FIG. 8, both the first period 40 and the second period 42 are complete before the end of the frame update period. In this embodiment, this time period is filled with a pair of alternating hold periods 44 and 46. Using the array of FIGS. 3-5 as an example, during the first hold period 44, the rows are all held at 0 volts, and the columns are all brought to +5 V. During the second hold period 46, the rows remain at 0 volts, and the columns are all brought to −5 V. Thus, during the period following array writing of Frame N, but before array writing of Frame N+1, bias potentials of opposite polarity are each applied to the elements of the array. During these periods, the state of the array elements does not change, but potentials of opposite polarity are applied to minimize charge buildup in the display elements.

Figure 9:
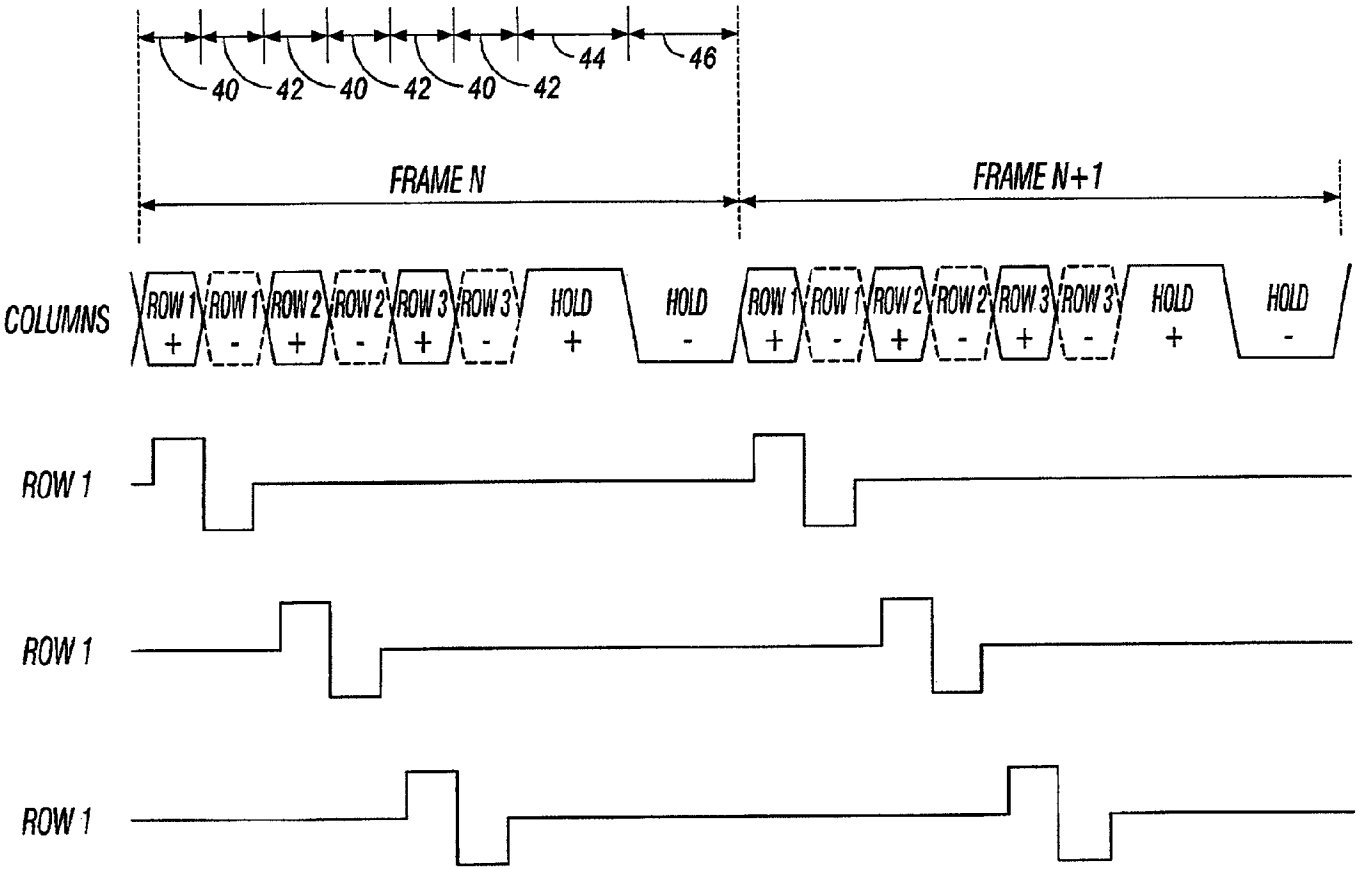
FIG. 9 is a timing diagram illustrating write and hold cycles during a frame update period in a first embodiment of the invention.

During the next frame update period for Frame N+1, the process may be repeated, as shown in FIG. 8. It will be appreciated that a variety of modifications of this overall method may be utilized to advantageous effect. For example, more than two hold periods could be provided. FIG. 9 illustrates an embodiment where the writing in opposite polarities is done on a row by row basis rather than a frame by frame basis. In this embodiment, the time periods 40 and 42 of FIG. 8 are interleaved. In addition, the modulator may be more susceptible to charging in one polarity than the other, and so although essentially exactly equal positive and negative write and hold times are usually most advantageous, it might be beneficial in some cases to skew the relative time periods of positive and negative polarity actuation and holding slightly. Thus, in one embodiment, the time of the write cycles and hold cycles can be adjusted so as to allow the charge to balance out. In an exemplary embodiment, using values selected purely for illustration and ease of arithmetic, an electrode material can have a rate of charging in positive polarity is twice as fast the rate of charging in the negative polarity. If the positive write cycle, write+, is 10 ms, the negative write cycle, write−, could be 20 ms to compensate. Thus the write+ cycle will take a third of the total write cycle, and the write− cycle will take two-thirds of the total write time. Similarly the hold cycles could have a similar time ratio. In other embodiments, the change in electric field could be non-linear, such that the rate of charge or discharge could vary over time. In this case, the cycle times could be adjusted based on the non-linear charge and discharge rates.

In some embodiments, several timing variables are independently programmable to ensure DC electric neutrality and consistent hysteresis windows. These timing settings include, but are not limited to, the write+ and write− cycle times, the positive hold and negative hold cycle times, and the row strobe time.

While the frame update cycles discussed herein have a set order of write+, write−, hold +, and hold −, this order can be changed. In other embodiments, the order of cycles can be any other permutation of the cycles. In still other embodiments, different cycles and different permutations of cycles can be used for different display update periods. For example, Frame N might include only a write+ cycle, hold+ cycle, and a hold− cycle, while subsequent Frame N+1 could include only a write−, hold+, and hold− cycle. Another embodiment could use write+, hold+, write−, hold− for one or a series of frames, and then use write−, hold−, write+, hold+ for the next subsequent one or series of frames. It will also be appreciated that the order of the positive and negative polarity hold cycles can be independently selected for each column. In this embodiment, some columns cycle through hold+ first, then hold−, while other columns go to hold− first and then to hold+. In one example, depending on the configuration of the column driver circuit, it may be more advantageous to set half the columns at −5 V and half at +5 V for the first hold cycle 44, and then switch all column polarities to set the first half to +5 V and the second half to −5 V for the second hold cycle 46.

It has also been found advantageous to periodically include a release cycle for the MEMS display elements. It is advantageous to perform this release cycle for one or more rows during some of the frame update cycles. This release cycle will typically be provided relatively infrequently, such as every 100,000 or 1,000,000 frame updates, or every hour or several hours of display operation. The purpose of this periodic releasing of all or substantially all pixels is to reduce the chance that a MEMS display element that is continually actuated for a long period due to the nature of the images being displayed will become stuck in an actuated state. In the embodiment of FIG. 8, for example, period 50 could be a write+ cycle that writes all the display elements of row 1 into a released state every 100,000 frame updates. The same may be done for all the rows of the display with periods 52, 54, and/or 60, 62, 64. Since they occur infrequently and for short periods, these release cycles may be widely spread in time (e.g. every 100,000 or more frame updates or every hour or more of display operation) and spread at different times over different rows of the display so as to eliminate any perceptible affect on visual appearance of the display to a normal observer.

Figure 10:
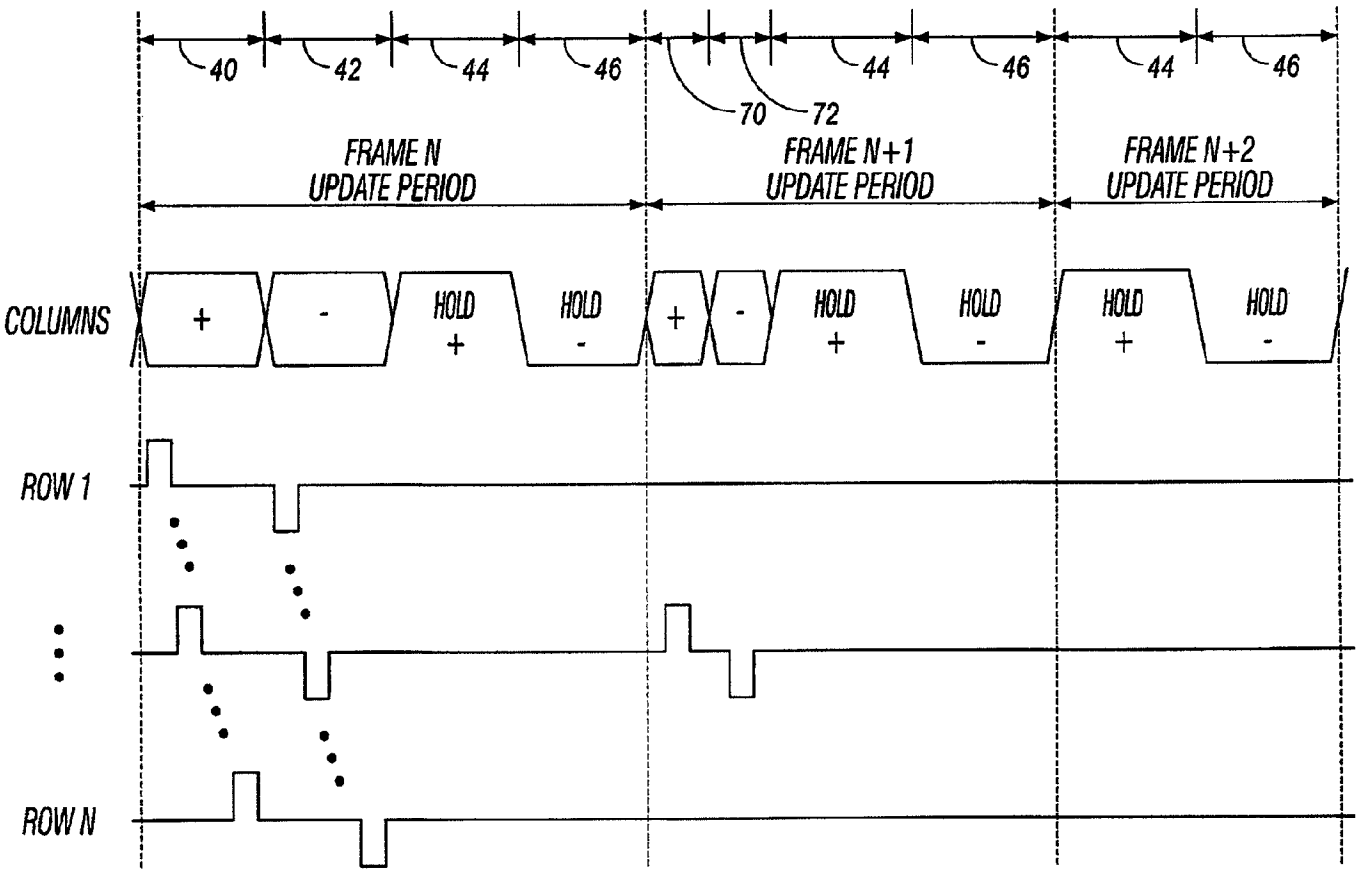
FIG. 10 is a timing diagram illustrating variable length write and hold cycles during frame update periods.

FIG. 10 shows another embodiment wherein frame writing may take a variable amount of the frame update period, and the hold cycle periods are adjusted in length in order fill the time between completion of the display write process for one frame and the beginning of the display write process for the subsequent frame. In this embodiment, the time to write a frame of data, e.g. periods 40 and 42, may vary depending on how different a frame of data is from the preceding frame. In FIG. 10, Frame N requires a complete frame write operation, wherein all the rows of the array are strobed. To do this in both polarities requires time periods 40 and 42 as illustrated in FIGS. 8 and 9. For Frame N+1, only some of the rows require updates because in this example, the image data is the same for some of the rows of the array. Rows that are unchanged (e.g. row 1 and row N of FIG. 10) are not strobed. Writing the new data to the array thus requires shorter periods 70 and 72 since only some of the rows need to be strobed. For Frame N+1, the hold cycles 44, 46 are extended to fill the remaining time before writing Frame N+2 is to begin.

In this example, Frame N+2 is unchanged from Frame N+1. No write cycles are then needed, and the update period for Frame N+2 is completely filled with hold cycles 44 and 46. As described above, more than two hold cycles, e.g. four cycles, eight cycles, etc. could be used.

Figure 11:
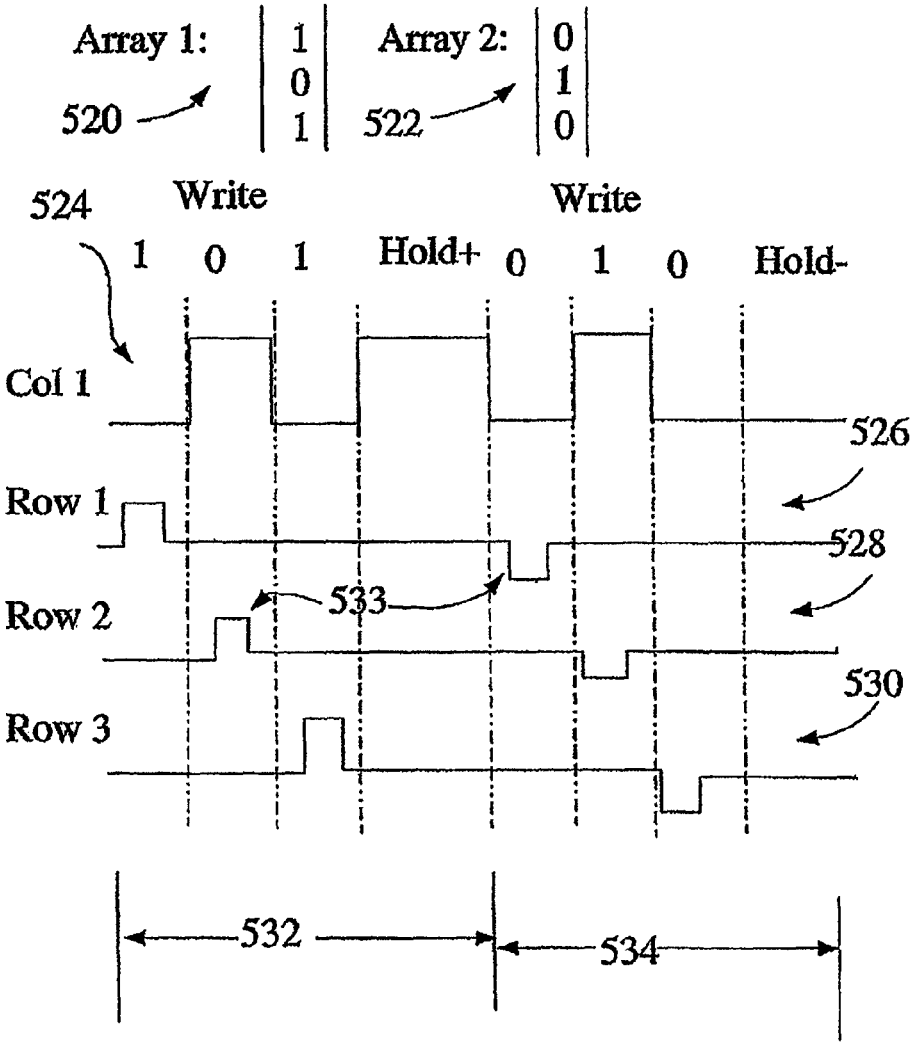
FIG. 11 is a timing diagram illustrating a drive process according to an embodiment.

FIG. 11 is a state diagram illustrating voltage differences with respect to time, for two frames in which a 1×3 array is updated using a preferred driving process. A first array status 520 represents a first frame, and the second array status 522 represents a second frame. A "1" in the array status 520 and the array status 522 illustrate an interferometric modulator in the "OFF," or near, position. The column 1 signal 524 provides the data signal for column 1 of the array 520. If additional columns were present, they could function simultaneously using the same row signals, wherein the pulses act as timing pulses to address the row.

During the first frame update 532, the column signal 524 is logically inverted from the data pattern of column 1 in the first array 520. The row signals 526, 528, and 530 will act as timing signals, wherein a pulse 533 indicates addressing of the row. In the first frame update 532, the row signals 526, 528, and 530 will pulse high. When the column signal 524 is low while a row signal is high, there will be a voltage difference across the electrodes of the particular interferometric modulator at the intersection of the column and row. When the first row signal 526 goes high, the column data signal 524 is low. The deformable layer 34, for example, will collapse if it was not already collapsed due to the differing voltage applied to the deformable layer 34 and the electrode 16, for example. If the cavity was already collapsed, nothing will happen. When the row 2 signal 528 goes high, the column data signal 524 is also high. In this case, the interferometric modulator addressed will be in the near position because the voltage difference between the deformable layer 34 and the electrode 16 will be low. When the third row signal 530 goes high, the column data signal 524 is low. Here, again, the deformable layer 34 at the particular row and column intersection will collapse if it was not already collapsed due to the differing voltage applied to the deformable layer 34 and the electrode 16.

When the row signals are not pulsing, they may be at a bias voltage. The difference between the bias voltage and the column signal is preferably within the hysteresis window, and thus the layers are maintained in their existing state. After the write cycle of the frame update, a hold cycle may occur. During the hold cycle the row signals 526, 528, and 530 will be at the bias voltage, and the column signal 524 is high. However, the column signal 524 could also be at different voltages, but this will not change the state of the interferometric modulators as long as the voltage differences are within the hysteresis window.

In the next frame update 534, the row signals 526, 528, and 530 sequentially go low to serve as timing pulses for addressing the row. The column signal 524 will be as seen in column 1 of the second array. However, the column data signal 524 will not be inverted from the status array 522 when the row signals go low as the timing pulse. When the row signal goes low, that row is addressed by the column signal 524. When the row signal is low and the column signal is low, there will be a very small voltage difference across the electrodes. For example, the column data signal 524 is high when the row voltage 526 is low, there will be a small voltage difference between the deformable layer 34 and the electrode 16. Thus, the deformable layer 34 will no longer be attracted to the electrode 16, and the deformable layer 34 will release, raising the reflective layer 14, for example, from an oxide layer formed on the electrode 16, for example. When the second row signal 528 goes low, the column data signal 524 is high. The deformable layer 34 will collapse if it was not already collapsed due to the differing voltage applied to the deformable layer 34 and the electrode 16. When the third row signal 530 goes low, the column data signal 524 is low. The deformable layer 34 will move away from the oxide layer if it was already collapsed due to the low voltage difference applied to the deformable layer 34 and the electrode 16. When the row signals are at the row bias voltage, the voltage difference is preferably within the hysteresis window and no change in state occurs. After the write cycle of the frame update, a hold cycle may occur. During the hold cycle the row signals 526, 528, and 530 will be at the bias voltage, and the column signal 524 is low. However, the column signal 524 could also be at different voltages, as long as the voltage difference is within the hysteresis window.

As mentioned above, the frame update cycles preferably also include a hold cycle. This will allow for time for new data to be sent to refresh the array. The hold cycle and the write cycles preferably alternate polarities so that a large charge does not build up on the electrodes. The row high voltage is preferably higher than the row bias voltage, which is higher than the row low voltage. In a preferred embodiment, all of these voltages applied on the column signal 524 and the row signals 526, 528, 530 are greater than or equal to a ground voltage. Preferably, the column hold voltages vary less than the column write voltages, so that the difference between the hold voltages and the row bias voltage will stay within the hysteresis window. In an exemplary embodiment, the column high and column low voltages vary by approximately 20 Volts, and the hold voltages vary 10 Volts. However, skilled practitioners will appreciate that the specific voltages used can be varied.

Note that the actuation or release of the upper membrane is not instantaneous. In order for the change in state to occur, the voltage must be outside the hysteresis window for a set length of time. This time period is defined by the following equation:

$$\tau_{Change\ Voltage} > \tau_{iMoD} + \tau_{RC}$$

In other words, in order to change the state of the interferometric modulator, the time at the change voltage, i.e. a voltage either greater than the actuation threshold voltage or less than the release threshold voltage, should be greater than the sum of two time constants. The first time constant is a mechanical constant of the interferometric modulator, which is determined with reference to the thickness of the electrodes, the dielectric material, and the materials of the electrodes. Other factors that are relevant to the mechanical constant include the geometry of the deformable layer 34, the tensile stress of the deformable layer 34 material, and the ease with which air underneath the interferometric modulator reflective layer 14 can be moved out of the cavity. The ease of moving the air is affected by placement of damping holes in the reflective layer 14. The second time constant is the time constant of the resistance and capacitance in the circuit connecting the driving element and the interferometric modulator.

Referring to FIG. 11, when the timing pulse (such as the timing pulse 533) is not present on the row signals 526, 528, 530, a bias voltage may be applied. In order to maintain the setting of the interferometric modulator when the bias voltage is applied on the timing signal, one of two conditions should be met. The first condition is that the absolute value of the voltage difference between the deformable layer 34 and the electrode 16 does not exceed an actuation voltage or fall below a release voltage. The absolute value of the (column minus row) voltage should have a value greater than the release voltage, but less than the actuation voltage, to remain in the hysteresis window. Thus, the column data signal should vary from the row bias voltage by at least the release voltage, but less than the actuation voltage. This may be used when only one polarity is used for the data signal and timing signal. This is preferred when the electronics are not capable of sourcing a large amount of current or the impedance on the lines of the circuit is large.

In addition to the first condition or in the alternative, the second condition should be met to avoid accidental state changes. The second condition is that the RMS voltage across the two electrodes (column minus row) should be greater than the absolute value of the release voltage and less than the absolute value of the actuation voltage. When the voltage hops between the negative hysteresis window and the positive hysteresis window in FIG. 3, the RMS voltage will enable the state to remain constant. RMS voltages vary based upon the transition time. In a preferred embodiment, the voltages on the electrodes switch rapidly, thus maintaining a large RMS voltage. If the voltage switches polarities slowly, the RMS voltage will fall and accidental state changes could occur.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. A method of actuating an electromechanical display element, the display element comprising a portion of an array of display elements, the method comprising:

writing display data to the display element with a potential difference of a first polarity during a first portion of a display write process;

applying a first bias potential to the display element during a second portion of the display write process, the first bias potential causing a first potential difference across the display element with the first polarity; and transitioning the potential applied to the display element from the first bias potential to apply a second bias potential polarity to the electromechanical display element during a third portion of the display write process, the second bias potential causing a second potential difference across the display element with a second polarity opposite the first polarity, wherein a transition time between applying the first bias potential and applying the second bias potential is configured such that the display element does not change states as a result of transitioning the voltage from the first bias potential to the second bias potential; and wherein a transition time between the bias potentials is less than or equal to "$\tau_{iMoD}$+"$\tau_{RC}$, wherein "$\tau_{iMoD}$ comprises a constant of the electromechanical display element determined with reference to physical characteristics of the electromechanical display element and wherein $\tau_{RC}$ comprises a constant related to electrical characteristics of the electromechanical display element.

2. The method of claim 1, further comprising writing display data to the electromechanical display element with a potential difference having a polarity opposite the first polarity during a fourth portion of the display write process.

3. The method of claim 2, wherein during the first portion of the display write process, a first frame of display data is written to the array of electromechanical display elements, and wherein during the fourth portion of the display write process, the first frame of display data is re-written to the array of electromechanical display elements.

4. The method of claim 3, wherein during the second and third portions of the display write process the first frame of display data is held following the re-writing.

5. The method of claim 4, additionally comprising writing a second frame of display data using the writing, re-writing, applying a first bias potential and applying a second bias potential.

6. The method of claim 2, wherein during the first portion of the display write process, a first row of display data is written to the array of electromechanical display elements, and wherein during the fourth portion of the display write process, the first row of display data is re-written to the array of electromechanical display elements.

7. The method of claim 6, wherein during the second and third portions of the display write process, the first row of display data is held following the re-writing.

8. The method of claim 7, additionally comprising writing a second row of display data using the writing, re-writing, applying a first bias potential and applying a second bias potential.

9. The method of claim 2, wherein the first, second, third, and fourth portions of the display write process each comprise approximately one-fourth of a time period defined by the inverse of a rate at which frames of display data are received by a display system.

10. A method of actuating an electromechanical display element, the display element comprising a portion of an array of display elements, the method comprising:

writing display data to the display element with a potential difference of a first polarity during a first portion of a display write process;

applying a first bias potential having the first polarity to the display element during a second portion of the display write process; and transitioning the potential applied to the display element from the first bias potential to apply a second bias potential having a polarity opposite the first polarity to the electromechanical display element during a third portion of the display write process, wherein a transition time between applying the first bias potential and applying the second bias potential is configured such that the display element does not change states as a result of transitioning the voltage from the first bias potential to the second bias potential, wherein the transition time is less than or equal to $\tau_{iMoD}+\tau_{RC}$, wherein $\tau_{iMoD}$ comprises a constant of the electromechanical display element determined with reference to physical characteristics of the electromechanical display element, and wherein $\tau_{RC}$ comprises a constant related to electrical characteristics of the electromechanical display element.

11. A method of maintaining a frame of display data on an array of electromechanical display elements, the method comprising alternately and sequentially transitioning a voltage applied to the electromechanical display elements between approximately equal bias potentials of opposite polarities so as to maintain a root mean square potential of the bias potentials within a hysteresis window of the electromechanical display elements wherein transitioning the voltage applied causes a potential difference across the display elements to vary between opposite polarities; and wherein a transition time between the bias potentials is less than or equal to "$\tau_{iMoD}$+"$\tau_{RC}$, wherein "$\tau_{iMoD}$ comprises a constant of the electromechanical display element determined with reference to physical characteristics of the electromechanical display element, and wherein $\tau_{RC}$ comprises a constant related to electrical characteristics of the electromechanical display element.

12. A method of maintaining a frame of display data on an array of electromechanical display elements, the method comprising alternately and sequentially transitioning a voltage applied to the electromechanical display elements between approximately equal bias potentials of opposite polarities so as to maintain a root mean square potential of the bias potentials within a hysteresis window of the electromechanical display elements, wherein a transition time between the bias potentials is less than or equal to $\tau_{iMoD}+\tau_{RC}$, wherein $\tau_{iMoD}$ comprises a constant of the electromechanical display element determined with reference to physical characteristics of the electromechanical display element, and wherein $\tau_{RC}$ comprises a constant related to electrical characteristics of the electromechanical display element.

13. A method of writing frames of display data to an array of electromechanical display elements at a rate of one frame per defined frame update period, the method comprising:

writing display data to the electromechanical display elements, wherein the writing takes less than the frame update period; and after the writing the display data, sequentially transitioning an applied voltage between bias potentials of alternating polarity to the electromechanical display elements for the remainder of the frame update period, wherein a root mean square potential of the applied voltage is within a hysteresis window of the electromechanical display elements, wherein transitioning the voltage applied causes a potential difference across the display elements to vary between opposite polarities; and wherein a transition time between the bias potentials is less than or equal to "$\tau_{iMoD}$+"$\tau_{RC}$, wherein "$\tau_{iMoD}$ comprises a constant of the electromechanical display element determined with reference to physical characteristics of the electromechanical display element and wherein $\tau_{RC}$ comprises a constant related to electrical characteristics of the electromechanical display element.

14. A method of writing frames of display data to an array of electromechanical display elements at a rate of one frame per defined frame update period, the method comprising:

writing display data to the electromechanical display elements, wherein the writing takes less than the frame update period; and after the writing the display data, sequentially transitioning an applied voltage between bias potentials of alternating polarity to the electromechanical display elements for the remainder of the frame update period, wherein a root mean square potential of the applied voltage is within a hysteresis window of the electromechanical display elements, wherein a transition time between consecutive bias potentials is less than or equal to $\tau_{iMoD}+\tau_{RC}$, wherein $\tau_{iMoD}$ comprises a constant of the electromechanical display element determined with reference to physical characteristics of the electromechanical display element, and wherein $\tau_{RC}$ comprises a constant related to electrical characteristics of the electromechanical display element.

15. The method of claim 13, wherein a bias potentially of a first polarity is applied during approximately half of the remainder of the frame update period, and a bias potentially of a second polarity is applied during approximately half of the remainder of the frame update period.

16. An electromechanical display device, comprising: an array of electromechanical display elements; and a driver configured to: write display data to the display elements with a potential difference of a first polarity during a first portion of a display write process, apply a first bias potential to the display element during a second portion of the display write process, the first bias potential causing a first potential difference across the display element with the first polarity, and transition the potential applied to the display element from the first bias potential to apply a second bias potential to the electromechanical display element during a third portion of the display write process, the second bias potential causing a second potential difference across the display element with a second polarity opposite the first wherein a transition time between applying the first bias potential and applying the second bias potential is configured such that the display element does not change states as a result of transitioning the voltage from the first bias potential to the second bias potential; and wherein a transition time between the bias potentials is less than or equal to "$\tau_{iMoD}$+"$\tau_{RC}$, wherein "$\tau_{iMoD}$ comprises a constant of the electromechanical display element determined with reference to physical characteristics of the electromechanical display element, and wherein $\tau_{RC}$ com rises a constant related to electrical characteristics of the electromechanical display element.

17. The device of claim 16, wherein the driver is further configured to write display data to the electromechanical display elements with a potential difference having a polarity opposite the first polarity during a fourth portion of the display write process.

18. The device of claim 17, wherein the driver is further configured to write a first row of display data to the array of electromechanical display elements during the first portion of the display write process, and to re-write the first row of display data to the array of electromechanical display elements during the fourth portion of the display write process.

19. The device of claim 18, wherein the driver is further configured to hold the first row of display data following the re-writing during the second and third portions of the display write process.

20. The device of claim 19, wherein the driver is further configured to write a second row of display data by writing the row of display data, re-writing the row of display data, applying a first bias potential, and applying a second bias potential.

21. An electromechanical display device, comprising:

an array of electromechanical display elements; and a driver configured to:

write display data to the display elements with a potential difference of a first polarity during a first portion of a display write process, apply a first bias potential having the first polarity to the display element during a second portion of the display write process, and transition the potential applied to the display element from the first bias potential to apply a second bias potential having a polarity opposite the first polarity to the electromechanical display element during a third portion of the display write process, wherein a transition time between applying the first bias potential and applying the second bias potential is configured such that the display element does not change states as a result of transitioning the voltage from the first bias potential to the second bias potential, wherein the transition time is less than or equal to $\tau_{iMoD}+\tau_{RC}$, wherein $\tau_{iMoD}$ comprises a constant of the electromechanical display element determined with reference to physical characteristics of the electromechanical display element, and wherein $\tau_{RC}$ comprises a constant related to electrical characteristics of the electromechanical display element.

22. An electromechanical display device, comprising: an array of electromechanical display elements; and a driver configured to alternately and sequentially transition a voltage applied to the electromechanical display elements between approximately equal bias potentials of opposite polarities so as to maintain a root means square value of the bias potentials within a hysteresis window of the electromechanical display elements, wherein transitioning the voltage applied causes a potential difference across the display elements to vary between opposite polarities; and wherein a transition time between the bias potentials is less than or equal to "$\tau_{iMoD}$+"$\tau_{RC}$, wherein "$\tau_{iMoD}$ comprises a constant of the electromechanical display element determined with reference to physical characteristics of the electromechanical display element and wherein $\tau_{RC}$ comprises a constant related to electrical characteristics of the electromechanical display element.

23. An electromechanical display device, comprising:

an array of electromechanical display elements; and a driver configured to alternately and sequentially transition a voltage applied to the electromechanical display elements between approximately equal bias potentials of opposite polarities so as to maintain a root mean square value of the bias potentials within a hysteresis window of the electromechanical display elements, wherein a transition time between the bias potentials is less than or equal to $\tau_{iMoD}+\tau_{RC}$, wherein $\tau_{iMoD}$ comprises a constant of the electromechanical display element determined with reference to physical characteristics of the electromechanical display element, and wherein $\tau_{RC}$ comprises a constant related to electrical characteristics of the electromechanical display element.

24. An electromechanical display device, comprising: an array of electromechanical display elements; and a driver configured to: write frames of display data to the array at a rate of one frame per defined frame update period, wherein the writing takes less than the frame update period, and after the writing the display data, sequentially transition an applied voltage between bias potentials of alternating polarity to the electromechanical display elements for the remainder of the frame update period, wherein a root mean square potential of the applied voltage is within a hysteresis window of the electromechanical display elements, wherein transitioning the voltage applied causes a potential difference across the display elements to vary between opposite polarities; and wherein a transition time between the bias potentials is less than or equal to "$\tau_{iMoD}$+"$\tau_{RC}$, wherein "$\tau_{iMoD}$ comprises a constant of the electromechanical display element determined with reference to physical characteristics of the electromechanical display element, and wherein $\tau_{RC}$ comprises a constant related to electrical characteristics of the electromechanical display element.

25. An electromechanical display device, comprising:

an array of electromechanical display elements; and a driver configured to:

write frames of display data to the array at a rate of one frame per defined frame update period, wherein the writing takes less than the frame update period, and after the writing the display data, sequentially transition an applied voltage between bias potentials of alternating polarity to the electromechanical display elements for the remainder of the frame update period, wherein a root mean square potential of the applied voltage is within a hysteresis window of the electromechanical display elements, wherein a transition time between consecutive bias potentials is less than or equal to $\tau_{iMoD}+\tau_{RC}$, wherein $\tau_{iMoD}$ comprises a constant of the electromechanical display element determined with reference to physical characteristics of the electromechanical display element, and wherein $\tau_{RC}$ comprises a constant related to electrical characteristics of the electromechanical display element.

26. The device of claim 24, wherein a bias potentially of a first polarity is applied during approximately half of the remainder of the frame update period, and a bias potentially of a second polarity is applied during approximately half of the remainder of the frame update period.

27. An electromechanical display device, comprising:

means for writing display data to the display element with a potential difference of a first polarity during a first portion of a display write process;

means for applying a first bias potential to the display element during a second portion of the display write process, the first bias potential causing a first potential difference across the display element with the first polarity; and means for transitioning the potential applied to the display element from the first bias potential to apply a second bias to the electromechanical display element during a third portion of the display write process, the second bias potential causing a second potential difference across the display element with a second polarity opposite the first polarity, wherein a transition time between applying the first bias potential and applying the second bias potential is configured such that the display element does not change states as a result of transitioning the voltage from the first bias potential to the second bias potential; and wherein a transition time between the bias potentials is less than or equal to "$\tau_{iMoD}$+"$\tau_{RC}$, wherein "$\tau_{iMoD}$ comprises a constant of the electromechanical display element determined with reference to physical characteristics of the electromechanical display element, and wherein $\tau_{RC}$ comprises a constant related to electrical characteristics of the electromechanical display element.

28. The device of claim 27, further comprising means for writing display data to the electromechanical display elements with a potential difference having a polarity opposite the first polarity during a fourth portion of the display write process.

29. An electromechanical display device, comprising:

means for writing display data to the display element with a potential difference of a first polarity during a first portion of a display write process;

means for applying a first bias potential having the first polarity to the display element during a second portion of the display write process; and means for transitioning the potential applied to the display element from the first bias potential to apply a second bias potential having a polarity opposite the first polarity to the electromechanical display element during a third portion of the display write process, wherein a transition time between applying the first bias potential and applying the second bias potential is configured such that the display element does not change states as a result of transitioning the voltage from the first bias potential to the second bias potential, wherein the transition time is less than or equal to $\tau_{iMoD}+\tau_{RC}$, wherein $\tau_{iMoD}$ comprises a constant of the electromechanical display element determined with reference to physical characteristics of the electromechanical display element, and wherein $\tau_{RC}$ comprises a constant related to electrical characteristics of the electromechanical display element.

30. An electromechanical display device, comprising: an array of electromechanical display elements; and means for alternately and sequentially transitioning a voltage applied to the electromechanical display elements between approximately equal bias potentials of opposite polarities so as to maintain a root mean square potential of the bias potentials within a hysteresis window of the electromechanical display elements, wherein transitioning the voltage applied causes a potential difference across the display elements to vary between opposite polarities; and wherein a transition time between the bias potentials is less than or equal to "$\tau_{iMoD}$+"$\tau_{RC}$, wherein "$\tau_{iMoD}$ comprises a constant of the electromechanical display element determined with reference to physical characteristics of the electromechanical display element and wherein $\tau_{RC}$ comprises a constant related to electrical characteristics of the electromechanical display element.

31. An electromechanical display device, comprising:

an array of electromechanical display elements; and means for alternately and sequentially transitioning a voltage applied to the electromechanical display elements between approximately equal bias potentials of opposite polarities so as to maintain a root mean square potential of the bias potentials within a hysteresis window of the electromechanical display elements, wherein a transition time between the bias potentials is less than or equal to $\tau_{iMoD}+\tau_{RC}$, wherein $\tau_{iMoD}$ comprises a constant of the electromechanical display element determined with reference to physical characteristics of the electromechanical display element, and wherein $\tau_{RC}$ comprises a constant related to electrical characteristics of the electromechanical display element.

32. An electromechanical display device, comprising: an array of electromechanical display elements; and means for writing frames of display data to the array at a rate of one frame per defined frame update period, wherein the writing takes less than the frame update period, and means for sequentially transitioning an applied voltage between bias potentials of alternating polarity to the electromechanical display elements for the remainder of the frame update period, wherein a root mean square potential of the applied voltage is within a hysteresis window of the electromechanical display elements, wherein transitioning the voltage applied causes a potential difference across the display elements to vary between opposite polarities; and wherein a transition time between the bias potentials is less than or equal to "$\tau_{iMoD}$+"$\tau_{RC}$, wherein "$\tau_{iMoD}$ comprises a constant of the electromechanical display element determined with reference to physical characteristics of the electromechanical display element, and wherein $\tau_{RC}$ comprises a constant related to electrical characteristics of the electromechanical display element.

33. An electromechanical display device, comprising:

an array of electromechanical display elements; and means for writing frames of display data to the array at a rate of one frame per defined frame update period, wherein the writing takes less than the frame update period, and means for sequentially transitioning an applied voltage between bias potentials of alternating polarity to the electromechanical display elements for the remainder of the frame update period, wherein a root mean square potential of the applied voltage is within a hysteresis window of the electromechanical display elements, wherein a transition time between consecutive bias potentials is less than or equal to $\tau_{iMoD}+\tau_{RC}$, wherein $\tau_{iMoD}$ comprises a constant of the electromechanical display element determined with reference to physical characteristics of the electromechanical display element, and wherein $\tau_{RC}$ comprises a constant related to electrical characteristics of the electromechanical display element.

* * * * *